US006007263A

United States Patent [19]

Imai et al.

[11] Patent Number: 6,007,263

[45] Date of Patent: Dec. 28, 1999

[54] DEVICE FOR PARALLEL JUSTIFICATION OF PRINT HEAD RELATIVE TO THE PLATEN

[75] Inventors: Kazuhide Imai, Fuchu; Shinji Ota, Ome; Hiroyuki Yoshida, Kokubunji, all of Japan

[73] Assignee: Casio Computer Co., Ltd., Tokyo, Japan

[21] Appl. No.: 09/029,107

[22] PCT Filed: Jun. 23, 1997

[86] PCT No.: PCT/JP97/02142

§ 371 Date: Feb. 20, 1998

§ 102(e) Date: Feb. 20, 1998

[87] PCT Pub. No.: WO97/49560

PCT Pub. Date: Dec. 31, 1997

[30] Foreign Application Priority Data

Jun. 25, 1996 [JP] Japan ..... 8-182668

[51] Int. Cl.[6] ..... B41J 29/02

[52] U.S. Cl. ..... 400/693; 400/55

[58] Field of Search ..... 400/55, 56, 693; 347/222

[56] References Cited

U.S. PATENT DOCUMENTS

| | | | |
|---|---|---|---|
| 4,497,682 | 2/1985 | Hamisch, Jr. | 101/93.04 |
| 4,944,621 | 7/1990 | Uecker | 400/691 |
| 4,966,476 | 10/1990 | Kuzuya et al. | 400/615.2 |
| 5,051,009 | 9/1991 | Sugiura et al. | 400/208 |
| 5,366,302 | 11/1994 | Masamura et al. | 400/120.16 |

FOREIGN PATENT DOCUMENTS

| | | | |
|---|---|---|---|
| 0 433 063 A1 | 6/1991 | European Pat. Off. . | |
| 0 497 352 A2 | 8/1992 | European Pat. Off. . | |
| 60-13563 | 1/1985 | Japan | 400/55 |
| 63-92463 | 4/1988 | Japan . | |
| 3-290277 | 12/1991 | Japan . | |
| 7-232464 | 9/1995 | Japan . | |

*Primary Examiner*—Ren Yan
*Assistant Examiner*—Daniel J. Colilla
*Attorney, Agent, or Firm*—Frishauf, Holtz, Goodman, Langer & Chick, P.C.

[57] ABSTRACT

A print head 20 is placed upstanding on a chassis 25 through a protective member 26. A support shaft 28 to which a platen roller 21 is attached through a support member 27 is fixed at a lower end to the chassis 25. The support shaft 28 is fixed at an upper end to an upper attaching portion 25*a* of the chassis 25. A space restricting member 31 is provided to the upper attaching portion 25*a* so as to engage with an engaging lug 35 on the protective member 26 to restrict the upper ends of the print head 20 and the platen roller 21 at a predetermined space from each other. Thus, the upper ends of the print head 20 and the platen roller 21 are maintained at the predetermined space during printing to press the print head 20 and platen roller 21 against each other with a uniform pressure along their lengths. As a result, there is no difference in printing state between the upper and lower portions of the print head 20 and the platen roller 21, and uniform printing and improved print quality can be achieved.

6 Claims, 21 Drawing Sheets

DEVICE FOR PARALLEL JUSTIFICATION OF PRINT HEAD RELATIVE TO THE PLATEN

TECHNICAL FIELD

The present invention relates to printers.

BACKGROUND ART

Conventionally, handy printers are known which are capable of printing desired information easily at a desired place.

In a printer of this type, for example, a printing tape cassette, which is provided with an ink ribbon and a printing tape, is removably set in the printer body. The ink ribbon and the printing tape are disposed in an overlapping manner between a print head and a platen roller in the printer body. In such a state, the platen roller presses the printing tape and the ink ribbon against the print head, and the platen roller is then rotated to feed the ink ribbon and the printing tape while the print head is being driven in accordance with print information to print desired information on the printing tape.

In this printer, the print head and the platen roller are disposed in an upstanding manner within the printer body so as to be closable with respect to each other. When the tape cassette is set within the printer body, the print head and the platen roller are moved away from each other, the ink ribbon and the printing tape are inserted from above in an overlapping manner in between the spaced print head and the platen roller. In printing, the platen roller approaches the print head to press the ink ribbon and the printing tape against the print head. The print head is attached to an upstanding protective member fixed at a lower end to a chassis attached within the printer body. The platen roller is attached rotatably at an upper and at a lower end to a support member which in turn is attached turnably to an upstanding support shaft, which is fixed at a lower end to the chassis. The support member is turned around the support shaft so as to move toward/away from the print head.

In such a printer, the protective member of the print head and the support shaft of the platen roller are fixed only at their lower ends to the chassis in an upstanding manner, but they are not fixed at their upper ends. Thus, by pressing the platen roller against the print head, the print head is likely to move away at its upper portion from the platen roller. Thus, the print head and the platen roller cannot be brought into uniform contact with each other through their lengths, so that there is a difference in printing state between the upper and the lower portions of the print head. As a result, uniform printing cannot be achieved and there is a deterioration in the print quality.

Such a problem would also arise in a structure in which the platen roller is fixed and in which the print head moves toward/away from the platen roller. In particular, when the respective lengths of the print head and the platen roller are increased to use a wider printing tape, the above described problem would be striking.

DISCLOSURE OF INVENTION

It is therefore an object of the present invention to provide a printer which prevents the print head and the platen roller from moving at one end from each other, and presses the print head and the platen with uniform pressure to improve the printing quality.

In order to achieve the above object, the present invention provides a printer in which at least one of a print head and a platen is attached at one end to a printer body, and any one of the print head and the platen moves to separably press the other of the print head and the platen, comprising:

a space restricting member attached to any one of the print head, platen, and printer body for engaging disengageably with the other end of the at least one of the print head and the platen to restrict the print head and the platen roller at a predetermined space from each other.

Thus, the space restricting member attached to any one of the print head, platen and the printer body is engaged with the other end of at least one of the print head and the platen to restrict the print head and the platen at a constant distance from each other. Thus, in printing, the print head and the platen are placed so as not to move away from each other to thereby press both uniformly against each other. Accordingly, there is no difference in printing state between the one and the other end of the print head and the platen to ensure uniform printing and hence improve the print quality.

In another aspect, the present invention also provides a printer in which at least one of a print head and a platen is attached at one end to a printer body, and any one of the print head and the platen moves to separably press the other of the print head and the platen, comprising:

a chassis attached within the printer body; and a space restricting member attached to the chassis for engaging disengageably with the other end of at least one of the print head and the platen to restrict the print head and the platen at a predetermined space from each other.

Thus, since the space restricting member is fixed firmly to the chassis, the space restricting member is not unsteady, and fixes at least one of the print head and the platen securely at one end. This securely prevents the print head and the platen from moving at one end from each other, and presses both uniformly against each other through their lengths. Thus, there is no difference in printing state between the one and the other end of the print head and the platen to ensure uniform printing. In a further aspect, the present invention also provides a printer in which at least one of a print head and a platen is attached at one end to a printer body, and any one of the print head and the platen moves to separably press the other of the print head and the platen, comprising:

a cover attached turnably to the printer body for covering the other ends of the print head and the platen openably; and a space restricting member attached to the cover for engaging disengageably with the other end of the at least one of the print head and the platen roller as the cover is openably closed to restrict the print head and the platen at a predetermined space from each other.

Thus, by opening/closing the cover, the other end of at least one of the print head and the platen is disengagably engaged by the space restricting member attached to the cover, so that the trouble to engage/disengage the space restricting member with/away from the other end of the print head or the platen is saved. Since the space restricting member is attached to the cover, a space which would otherwise be required for attaching the space restricting member to the printer body is eliminated to reduce the size of the printer.

BEST MODE FOR CARRYING OUT THE INVENTION

First Embodiment

Referring to FIGS. 1–20, a first embodiment of a printer according to the present invention will be described.

Figure 1:
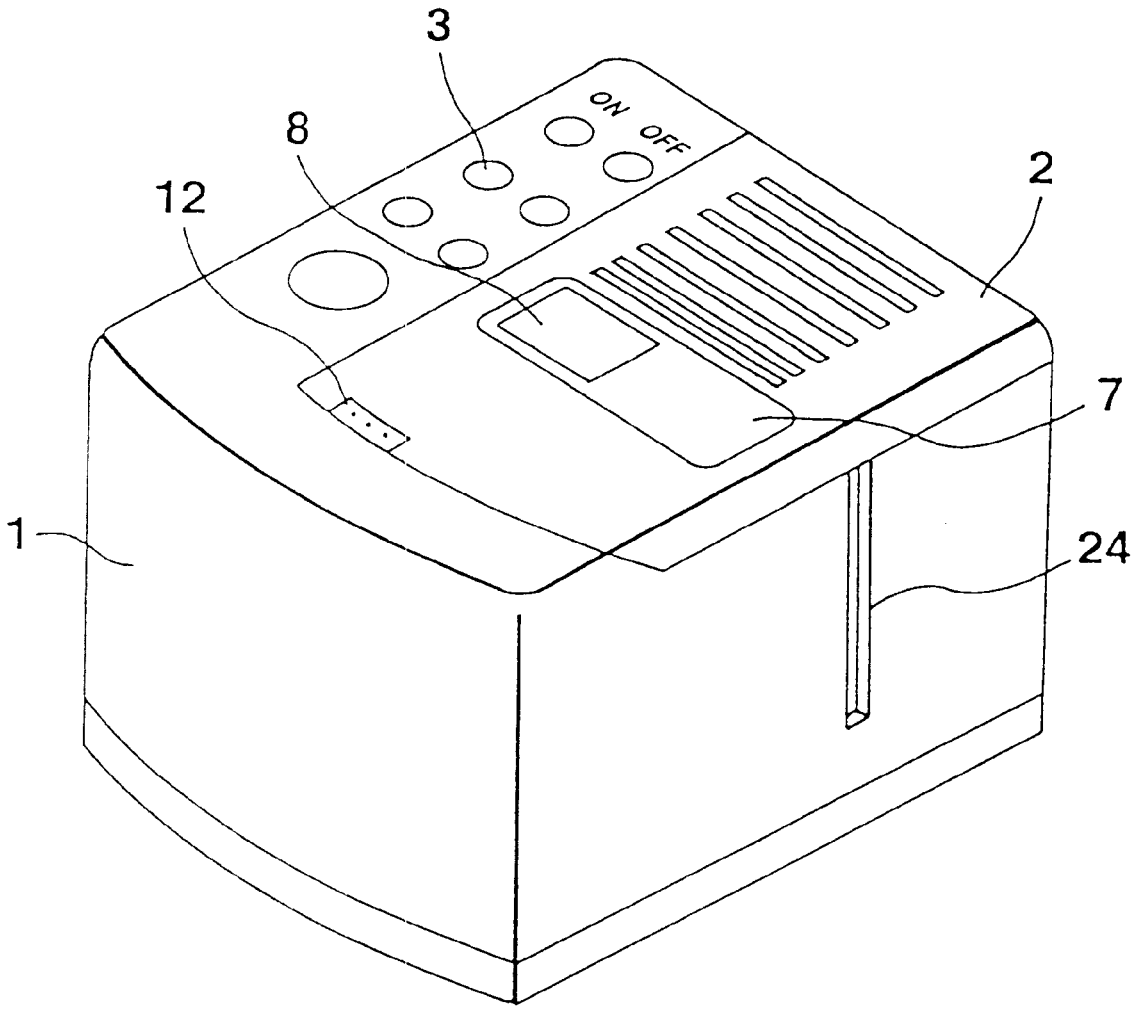
FIG. 1 is a perspective view of a first embodiment of a printer according to the present invention.
Figure 2:
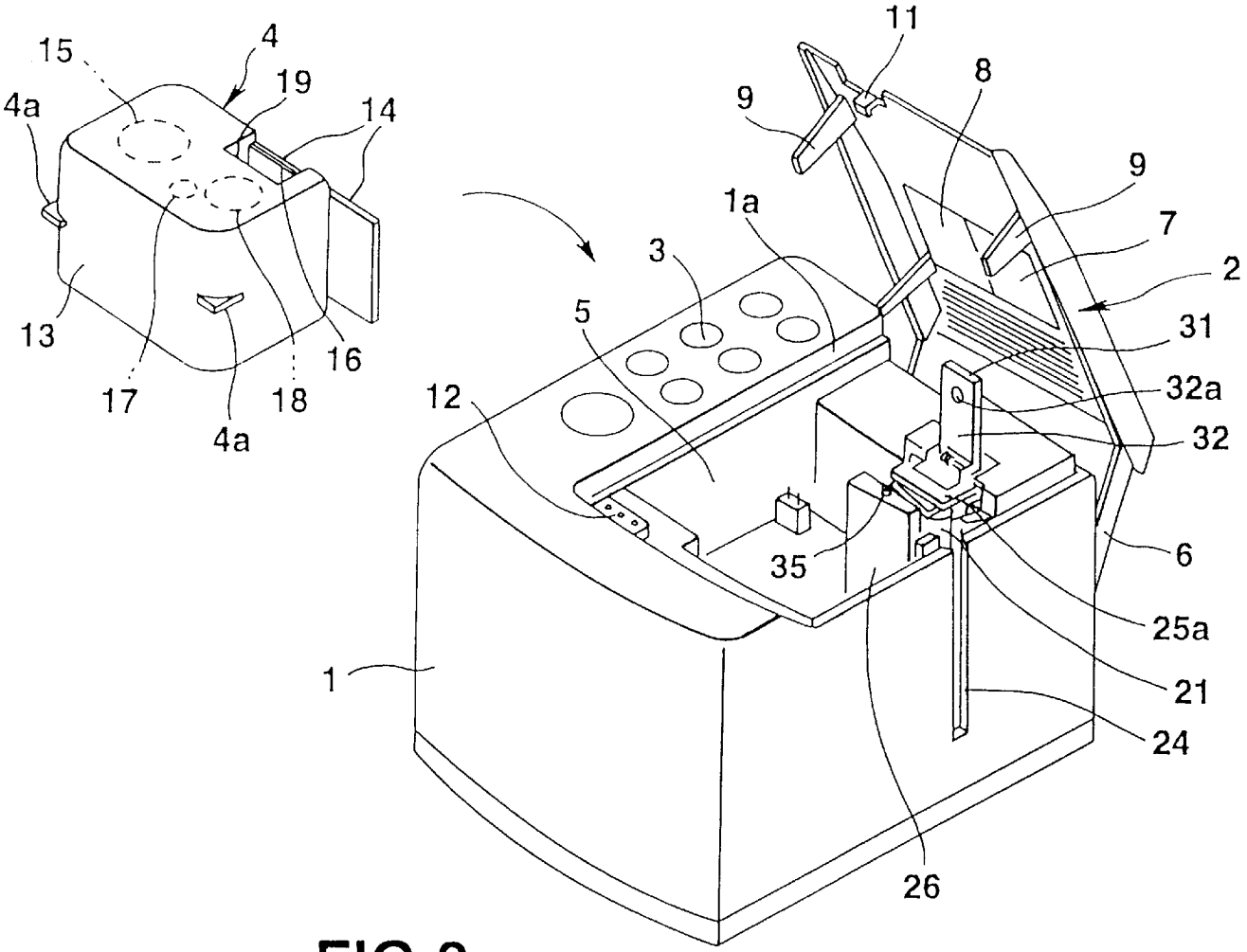
FIG. 2 is a perspective view of the printer of FIG. 1, showing insertion of a tape cassette into the printer by opening a cassette cover in FIG. 1.
Figure 3:
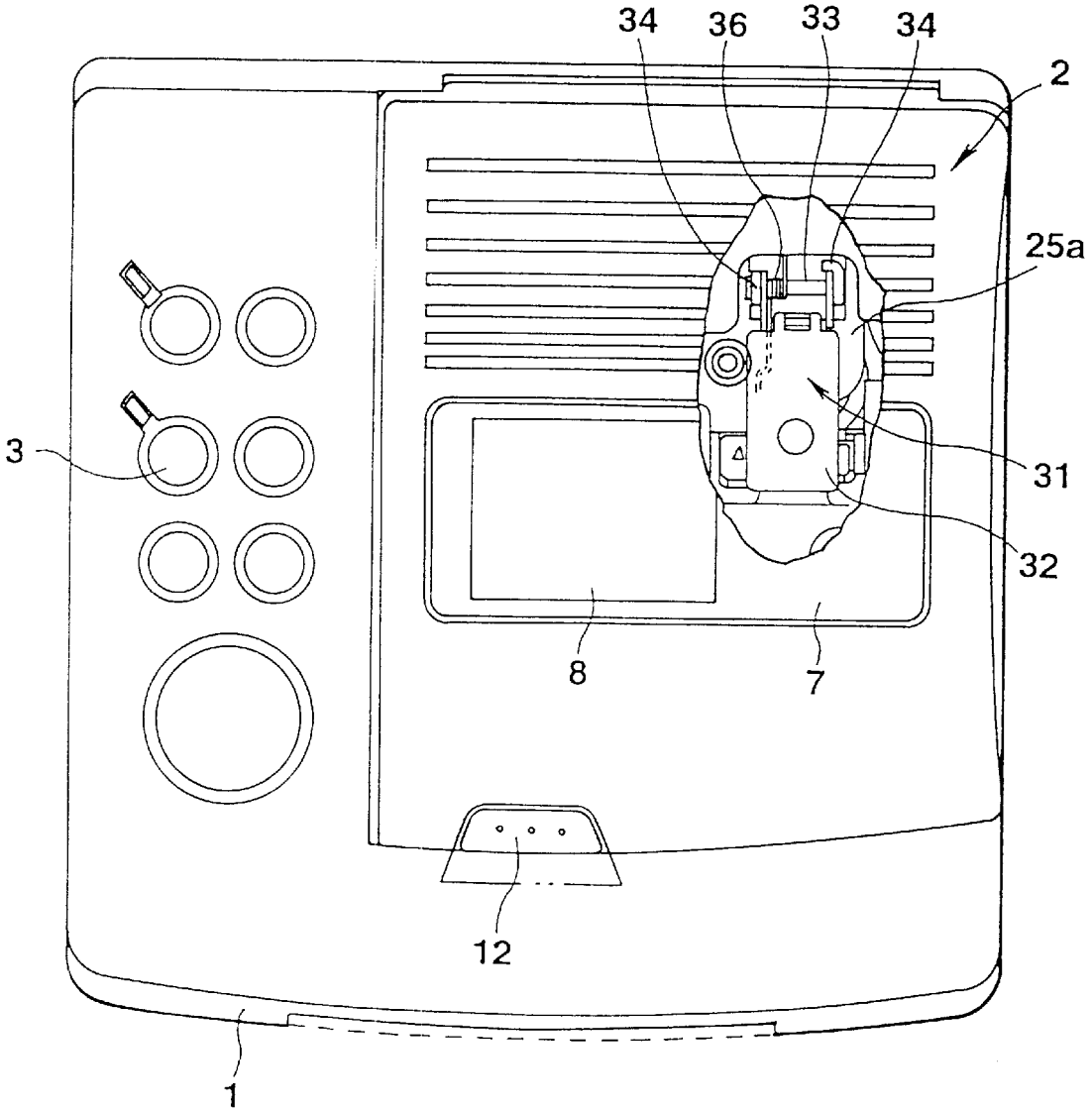
FIG. 3 is a partially broken-away enlarged plan view of FIG. 1.
Figure 4:
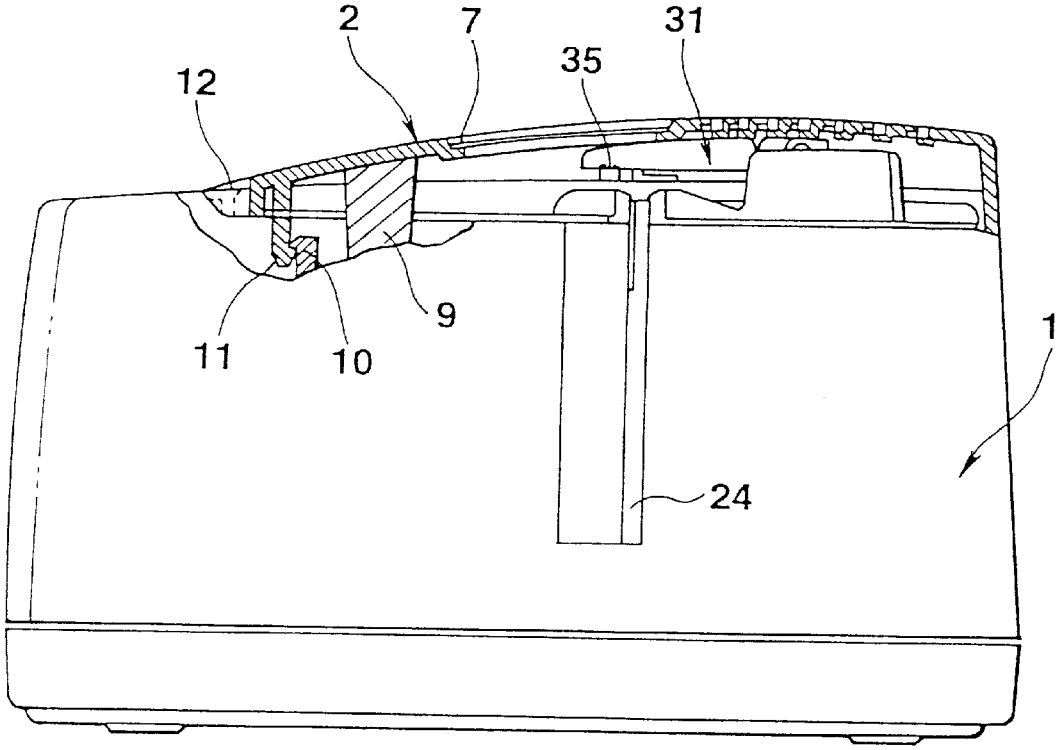
FIG. 4 is a partially broken-away enlarged side view of FIG. 1.
Figure 5:
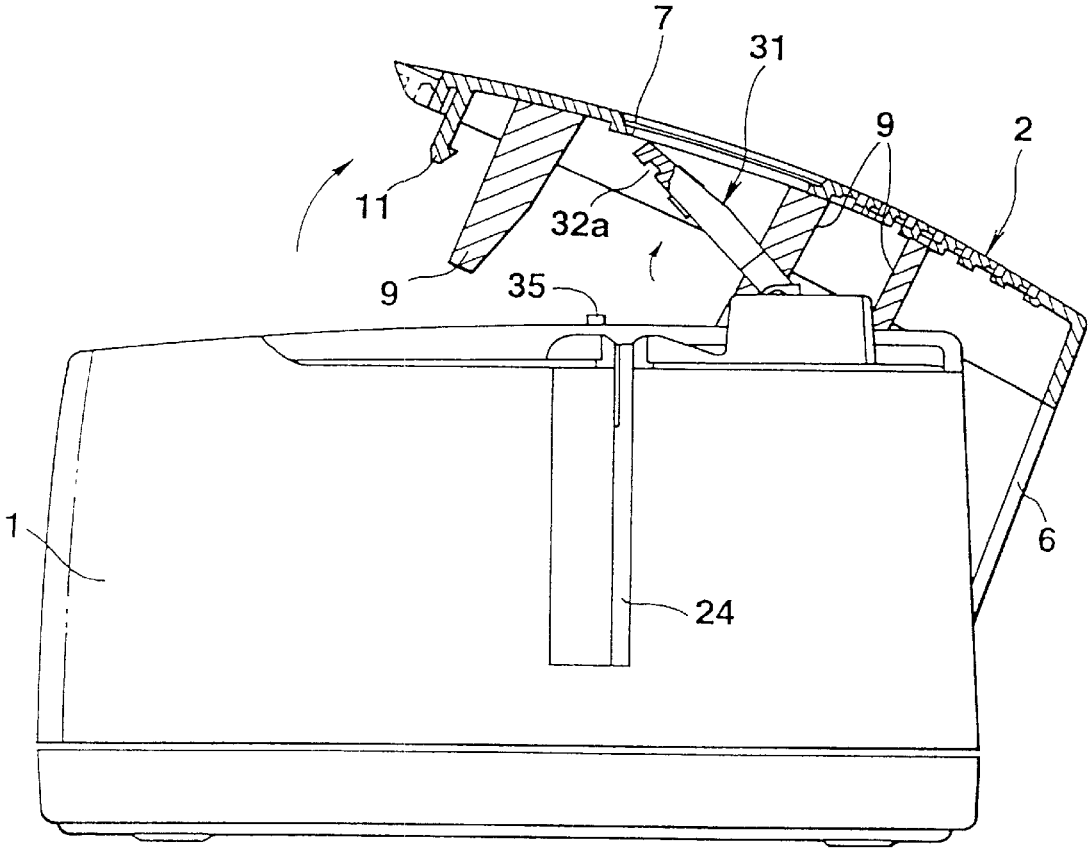
FIG. 5 is an enlarged side view of the printer, showing a partially opened cassette cover.
Figure 6:
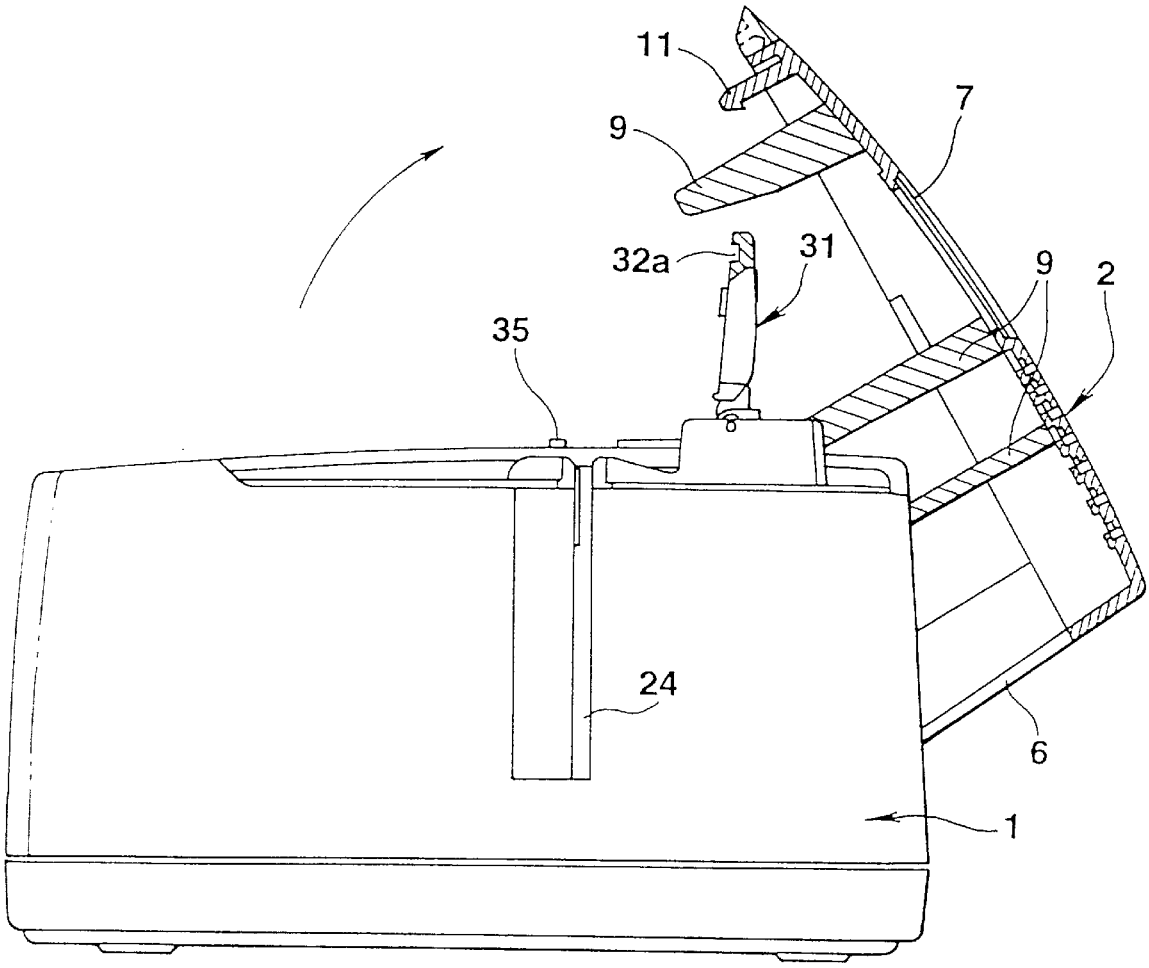
FIG. 6 is an enlarged side view of the printer, showing the completely opened cassette cover of FIG. 5.

FIGS. 1–3 show the appearance of the printer, which is a handy one capable of performing a color printing operation, and is provided with a body 1. A cassette cover 2 is openably provided on an upper surface of the printer body 1. A switch unit 3 composed of various switches such as an on/off switch and a print starting switch is provided in the vicinity of the cassette cover 2. A cassette receiving recess 5 open up at 1*a* in which a printing tape cassette 4 of FIG. 2 is removably set is provided below the cassette cover 2 within the body 1.

The cassette cover 2 has at its rear end an attaching member 6 which is attached turnably at a lower end to the back of the printer body 1. The cover 2 has a central recess 7, a left half of which receives a display 8 which displays print information and/or other information inputted by the switch unit 3. Downward protruding guides 9 are provided along both the opposite sides of the lower surface of the cassette cover 2 to depress corresponding horizontal collar lugs 4*a* provided along opposite sides of the tape cassette 4 from above when the cassette cover 2 is openably closed to fix the tape cassette 4 to the body 1. As shown best in FIG. 4, a hook 11 is provided on a lower surface of a forward end of the cassette cover 2 to be engaged with an engaging portion 10 in the printer body 1 when the cassette cover 2 is closed. The engaging portion 10 in the body 1 is disengaged from the hook 11 of the cassette cover 2 when a push button unit 12 provided on an upper surface of the body 1 is depressed.

A tape cassette 4 to be set in the cassette receiving recess 5 has a cassette case 13 shown in FIG. 2. Provided within the cassette case 13 are a tape feed reel 15 around which a printing tape 14 is wound, a ribbon feed reel 17 around which an ink ribbon 16 is wound, and a ribbon winding reel 18 around which winds the ink ribbon 16. In such situation, the printing tape 14 fed out from the tape feed reel 15 and the ink ribbon 16 fed out from the ribbon feed reel 17 are disposed movably in an overlapping manner within a recess 19 on a side of the cassette case 13. The ink ribbon 16 is a color ink tape composed of a cyan ink portion, a magenta ink portion, a yellow ink portion, a transparent laminate portion of the same length arranged repeatedly in this order.

Figure 7:
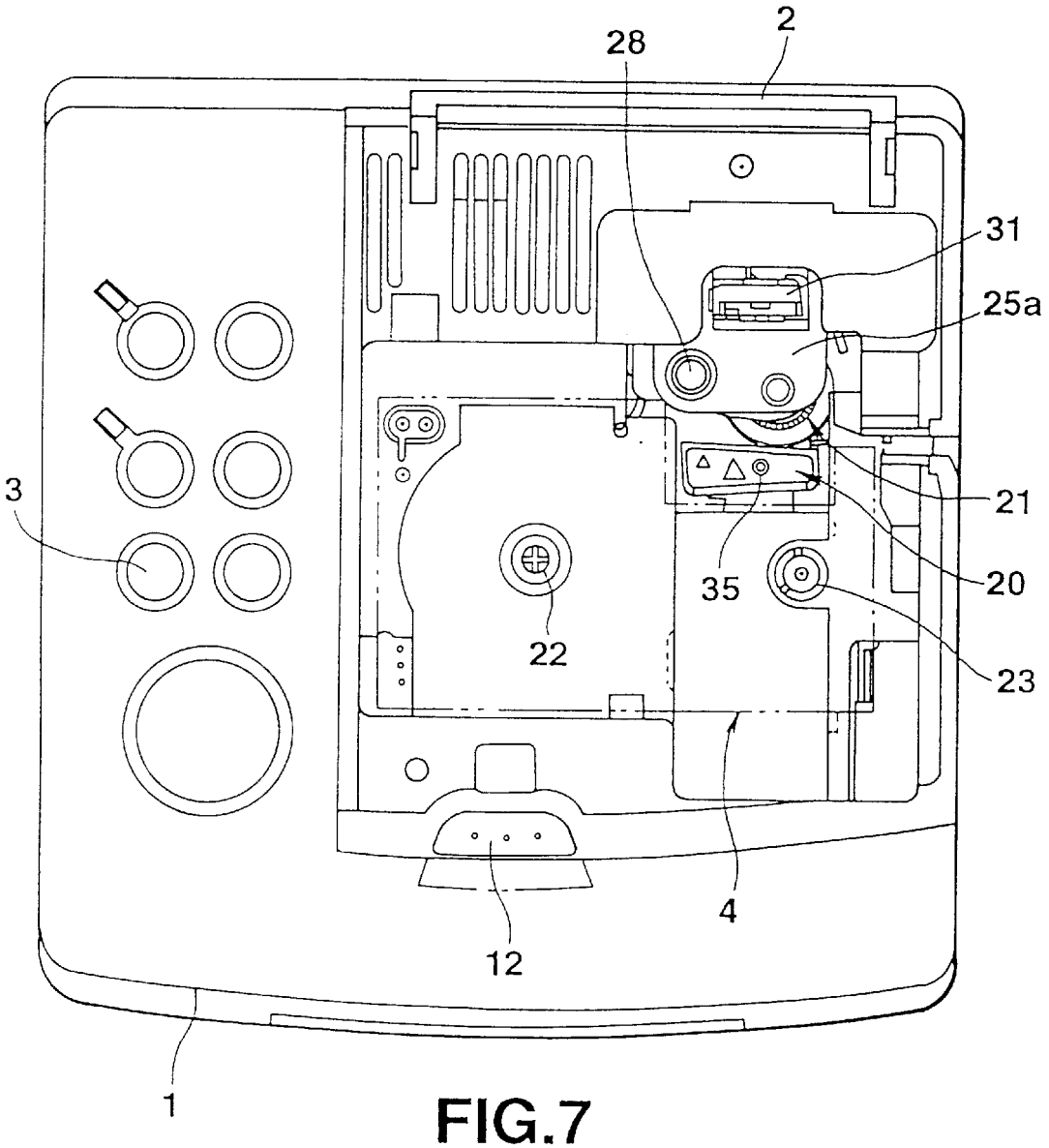
FIG. 7 is a plan view of the printer with the FIG. 1 cassette cover being open.

As shown in FIGS. 2 and 7, a heat producing type print head 20, a platen roller 21, a tape feed shaft 22, and a ribbon winding shaft 23 are disposed in an upstanding manner within the cassette receiving recess 5 in the body 1. When the tape cassette 4 is set within the receiving space 5, the tape feed shaft 22 is inserted into a hollow cylinder of the tape feed reel 15, the ribbon winding shaft 23 is inserted into a hollow cylinder of the ribbon winding reel 18, and the print head 20 is inserted into the side recess 19 on the cassette case 13, so that the overlapping printing tape 14 and ink ribbon 16 are disposed between the print head 20 and the platen roller 21. In this state, an ink in the ink ribbon 16 is transferable by the print head 20 onto the printing tape 14. A printed printing tape 14 is discharged from a tape exit 24 in the body 1 to the outside. The ink ribbon 16 used in the printing is then wound around the ribbon winding reel 18 in the cassette case 13.

Figure 8:
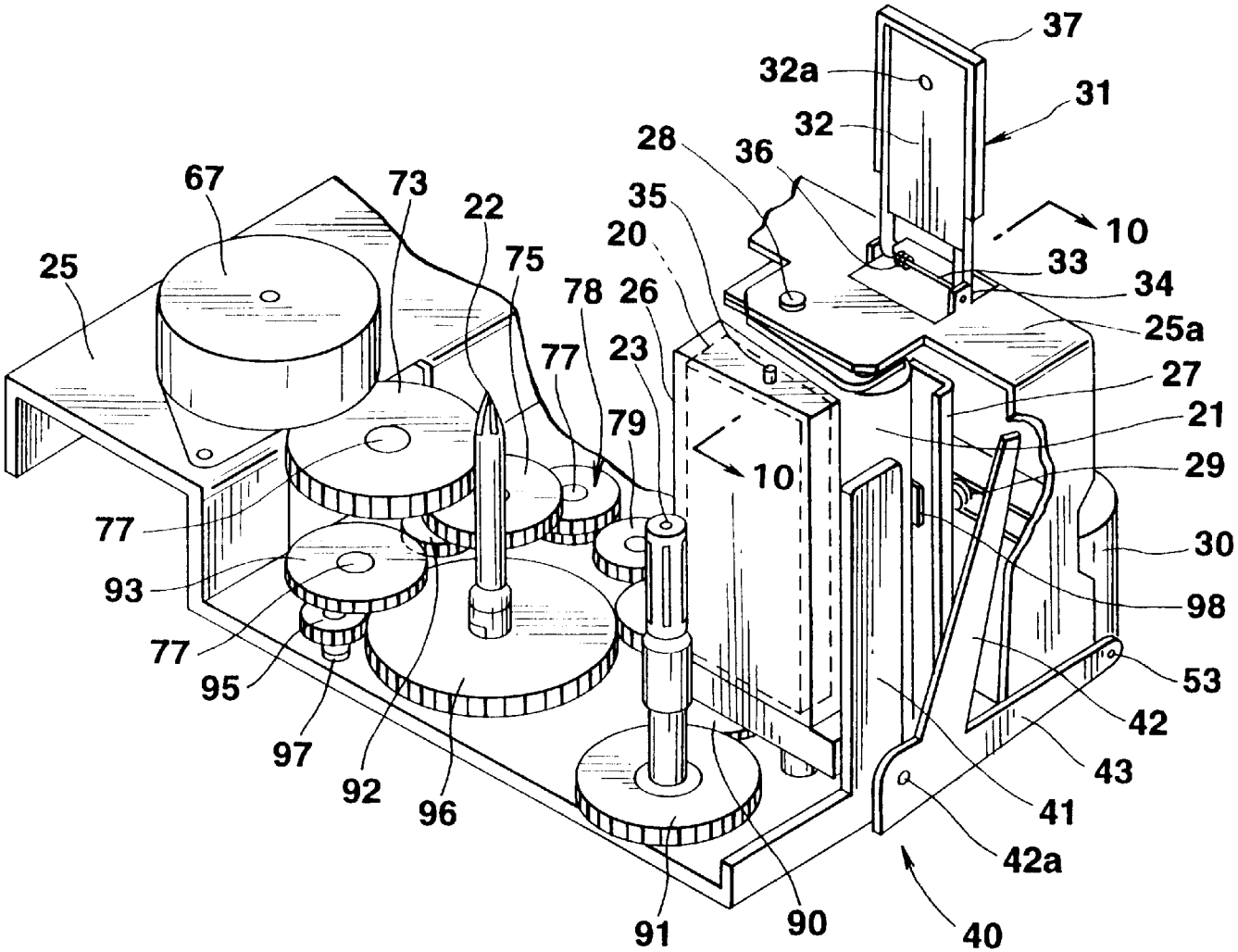
FIG. 8 is a perspective view of an essential portion of the internal structure of the printer of FIG. 1.
Figure 9:
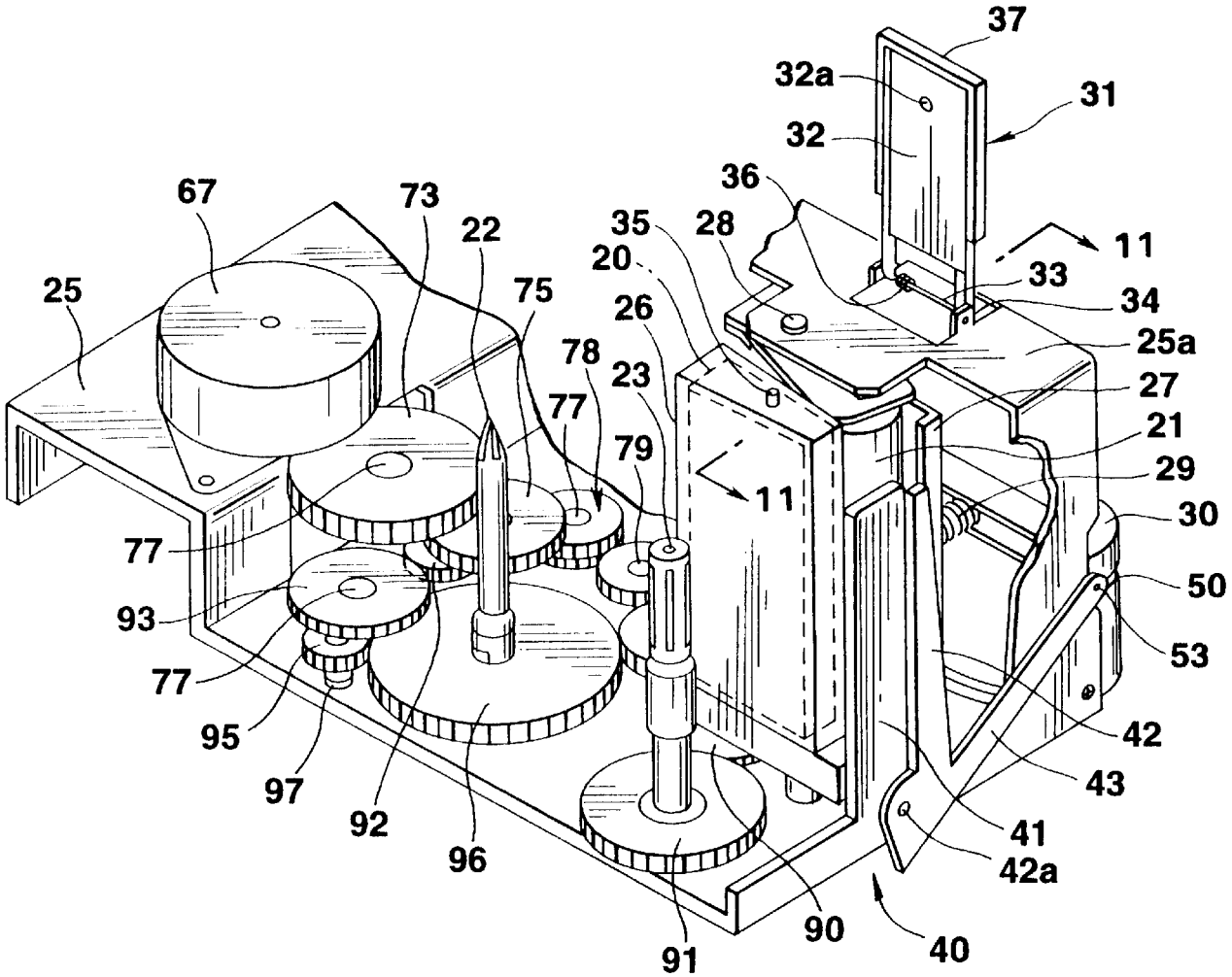
FIG. 9 is a perspective view of the printer of FIG. 8, especially showing the cutting operation by a cutter in the state of FIG. 8.

The print head 20 is a thermal head in which a plurality of heat producing elements are arranged so as to extend vertically to generate heat appropriately in accordance with print information. As shown in FIGS. 8 and 9, the thermal head is fixed within an upstanding protective member 26 which is fixed at a lower end to the chassis 25 which in turn is fixed to the printer body 1. The chassis 25 and the protective member 26 which is a part of the chassis are made of a mechanically strong rigid material such as stainless steel and appropriately bent at required positions.

The platen roller 21 is made of an elastic material such as rubber. As shown in FIGS. 8–11, a vertical shaft 21*a* extending through the platen roller 21 at its center is rotatably attached at its upper and lower ends in a U-like support member 27. The support member 27 is, in turn, attached turnably to a vertical support shaft 28, which is fixed at a lower end to the chassis 25 and at an upper end to an upper attaching portion 25*a* of the chassis (a part of the chassis 25) positioned above the support member 27. The support member 27 and hence the platen roller 21 are biased toward the print head 20 by a coil spring 29 provided between the support member 27 and the chassis 25. When the support member 27 turns around the support shaft 28 depending on the rotation of a cam member 30 (which will be described later in more detail) in this state, the platen roller 21 moves toward/away from the print head 20.

As shown in FIGS. 2–5, a space restricting member 31 is provided facing the right half of the recess 7 in the cassette cover 2 on the upper attaching portion 25*a* of the chassis 25 to which the support shaft 28 is fixed at its upper end. The space restricting member 31 composed of a rigid flat plate 32 made, for example, of stainless steel is attached turnably at one end by an axle pin 33 to a pair of upstanding attaching lugs 34 extending from the upper attaching portion 25*a* of the chassis 25. The flat plate 32 has an engaging hole 32*a* in the other end thereof in which an engaging lug 35 integral with the protective member 26 of the print head 20 is disengageably engaged to maintain the respective upper ends of the print head 20 and the platen roller 21 at a constant space from each other.

The space restricting member 31 is biased by a torsion spring 36 attached to the axle pin 33 so that the flat plate 32 thereof is substantially upstanding. When the flat plate 32 becomes upstanding by the resiliency of the torsion spring 36, the cassette cover 2 is pushed upward to open. A synthetic resin cover 37 (FIG. 8) is attached to an upper surface of the flat plate 32 so as to cover the engaging hole 32*a* from above and come into contact with the inside of the cassette cover 2. A synthetic resin damper (not shown) which damps impacts which the flat plate 32 gives is preferably disposed on an upper surface of the protective member 26 of the print head 20.

As shown in FIGS. 8 and 9, a cutter 40 which cuts the printing tape 14 is provided at the tape exit 24 in the vicinity of the print head 20 and the platen roller 21. The cutter 40 is composed of an edge 41 fixed at a lower end to the chassis 25 and substantially upstanding along a passageway of the printing tape 14, and a movable edge 42 attached rotatably to the lower end of the fixed edge 41 by a rivet pin 42*a*, so that a cutter arm 43 extending backward from the lower end of the movable edge 42 turns in a vertical plane depending on the rotation of the cam member 30 and hence the movable edge 42 turns toward the fixed edge 41 to cut a printed tape 14 away.

Figure 13A:
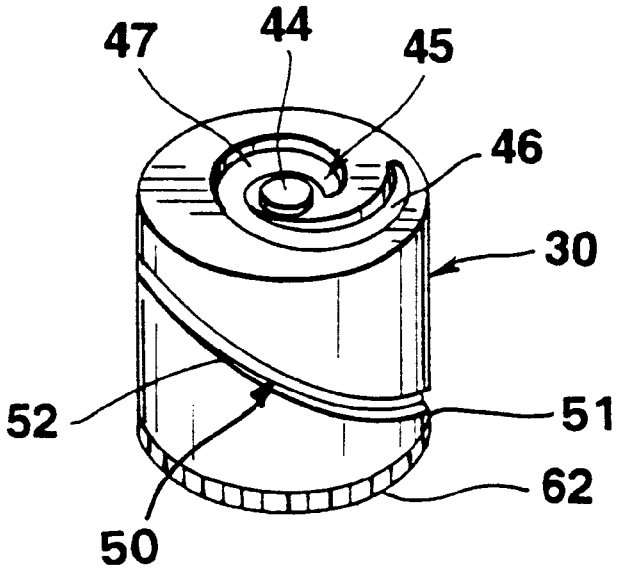
FIGS. 13A and 13B are a perspective view and a bottom view, respectively, of a cam member.
Figure 13B:
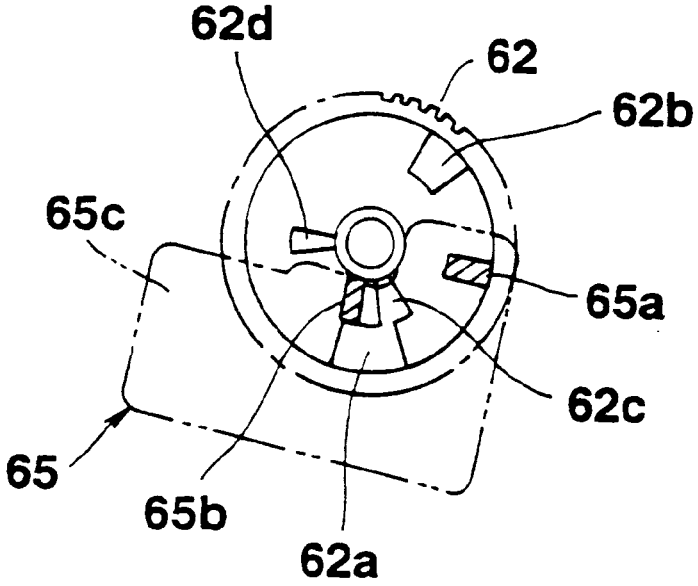

The cam member 30 controls the operation of the platen roller 21 and the cutter 40, and takes the form of a cylinder, as shown best in FIGS. 13A and 13B. As shown in FIGS. 8–11, the cam member 30 is attached rotatably to an upstanding fixed shaft 44 provided on the chassis 25 behind the platen roller 21. As shown best in FIG. 13A, a first spiral cam groove 45 is formed on an upper surface of the cam member 30 so as to move the platen roller 21 toward/away from the print head 20. As shown also in FIG. 13A, a second spiral cam groove 50 is formed on the outer peripheral surface of the cam member 30 so as to turn the movable edge of the cutter 40.

The first cam groove 45 is composed of a curved roller drive groove portion 46 extending arcuately from a point on the upper surface of the cam cylinder in the vicinity of the outer periphery of the cam member 30 to a point in the vicinity of the fixed shaft 44, and a semicircular non-drive groove portion 47 continuous to the roller drive groove portion 46 and extending along substantially half of the periphery of a circle whose center is the fixed shaft 44. As shown in FIGS. 19–23, a connection pin 49 provided at a forward end of a roller arm 48 extending from the back of the support member 27 is inserted movably into the first cam groove 45. The state in which the connection pin 49 is at the radially outward end of the roller drive groove portion 46 in the vicinity of the outer periphery of the cam cylinder is the initial state in which the platen roller 21 start to be moved away from the print head 20. When the connection pin 49 moves in the roller drive groove portion 46 relative to same from the radially outermost end of the roller drive groove portion 46 in the cam member 30 to near the fixed shaft 44, the platen roller 21 is caused to move toward the print head 20. When the connection pin 49 moves in the non-drive groove portion 47 relative to same, the non-drive groove portion 47 only turns around the fixed shaft 44 while the connection pin 49 is maintained stationary, the roller arm 48 does not move, and the platen roller 21 is maintained pressed against the print head 20.

The second cam groove 50 is composed of a substantially ring-like non-drive groove portion (not shown) extending substantially along a lower edge of the cam member 30, and a cut drive groove portion 52 continuous to the non-drive groove portion and extending toward the upper end of the cam member 30 in a spiral manner. As shown in FIGS. 8–9 and FIGS. 19–23, a connection pin 53 provided at a forward end of the cutter arm 43 of the movable edge 42 is movably inserted into the second cam groove 50. When the connection pin 53 moves in the non-drive groove portion relative to same, it only moves in the non-drive groove portion in a direction where the non-groove portion 51 is perpendicular to the fixed shaft 44, the connection pin 53 is maintained stationary, and the cutter arm 43 does not turn in a vertical plane. Thus, the cutter 40 does not operate. When the connection pin 53 moves upward from below in the cut drive groove portion 52, it turns the cutter arm 43 upward, moves the movable edge 42 to the fixed edge 41 to cut away the printing tape 14. When the connection pin 53 moves downward from above in the cut drive groove portion 52, it turns the cutter arm 43 downward to move the movable edge 42 away from the fixed edge 41.

Figure 12:
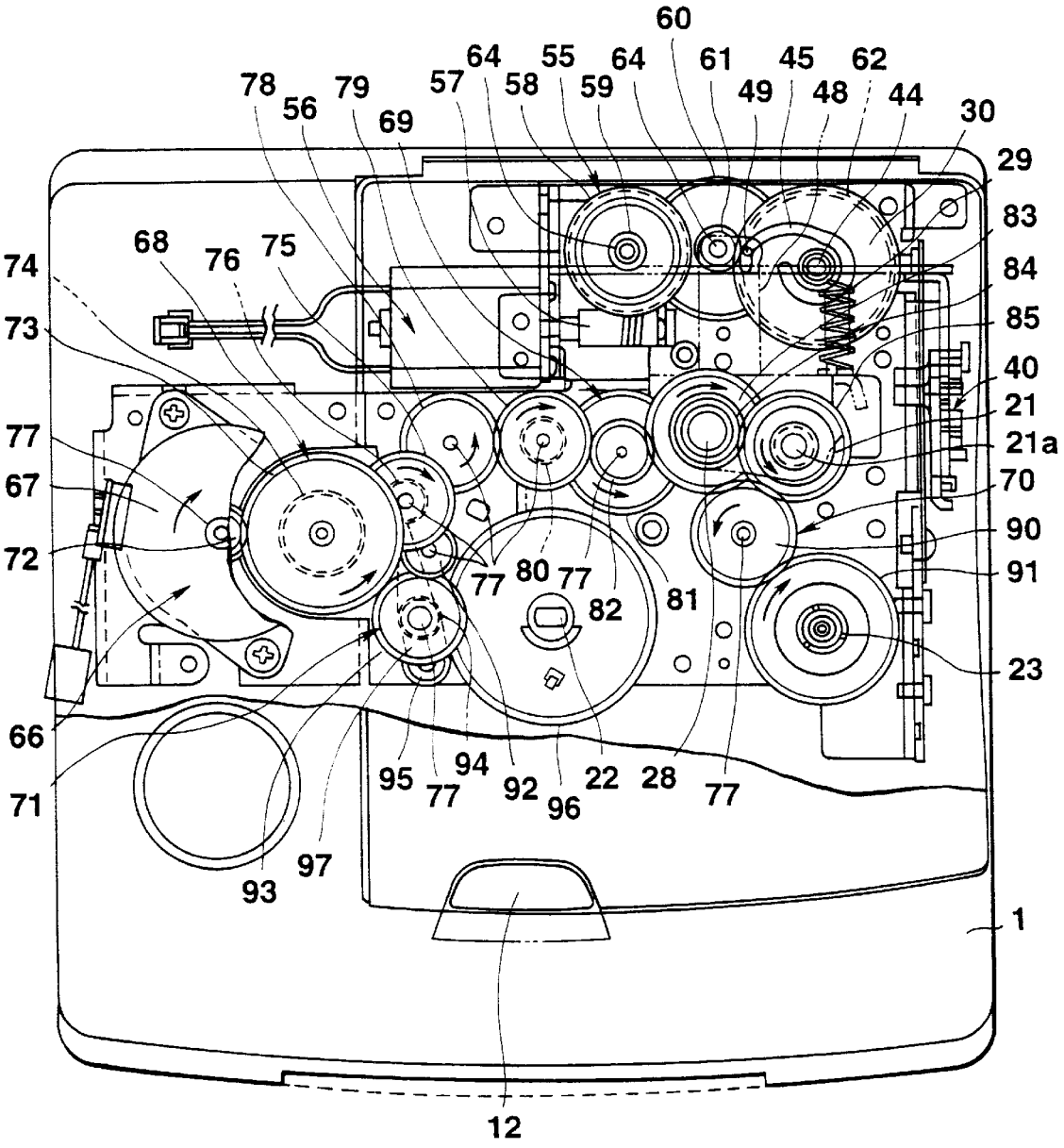
FIG. 12 is a plan view of a cam driving mechanism and a print driving mechanism of the printer.

As shown in FIG. 12, a cam drive mechanism 55 which drives the cams 30 is composed of a first motor 56, a screw-like axial gear 57 provided on an output shaft of the first motor 56, a first larger-diameter intermediate gear 58 than the axial gear 57 and rotating in meshing relationship to the shaft gear 57, a first smaller-diameter intermediate gear 59 provided integral with the first larger-diameter intermediate gear 58, a second larger-diameter intermediate gear 60 rotating in meshing relationship to the first smaller-diameter intermediate gear 59, a second smaller-diameter intermediate gear 61 integral with the second larger-diameter intermediate gear 60, and a cam follower gear 62 rotating in meshed relationship to the second smaller-diameter intermediate gear 61. In this case, the cam follower gear 62 is integral with the lower end of the cam member 30. The respective gears 58–61 are attached rotatably through related shaft 64 on an attachment plate (not shown) provided on a lower surface of the chassis 25.

Figure 10:
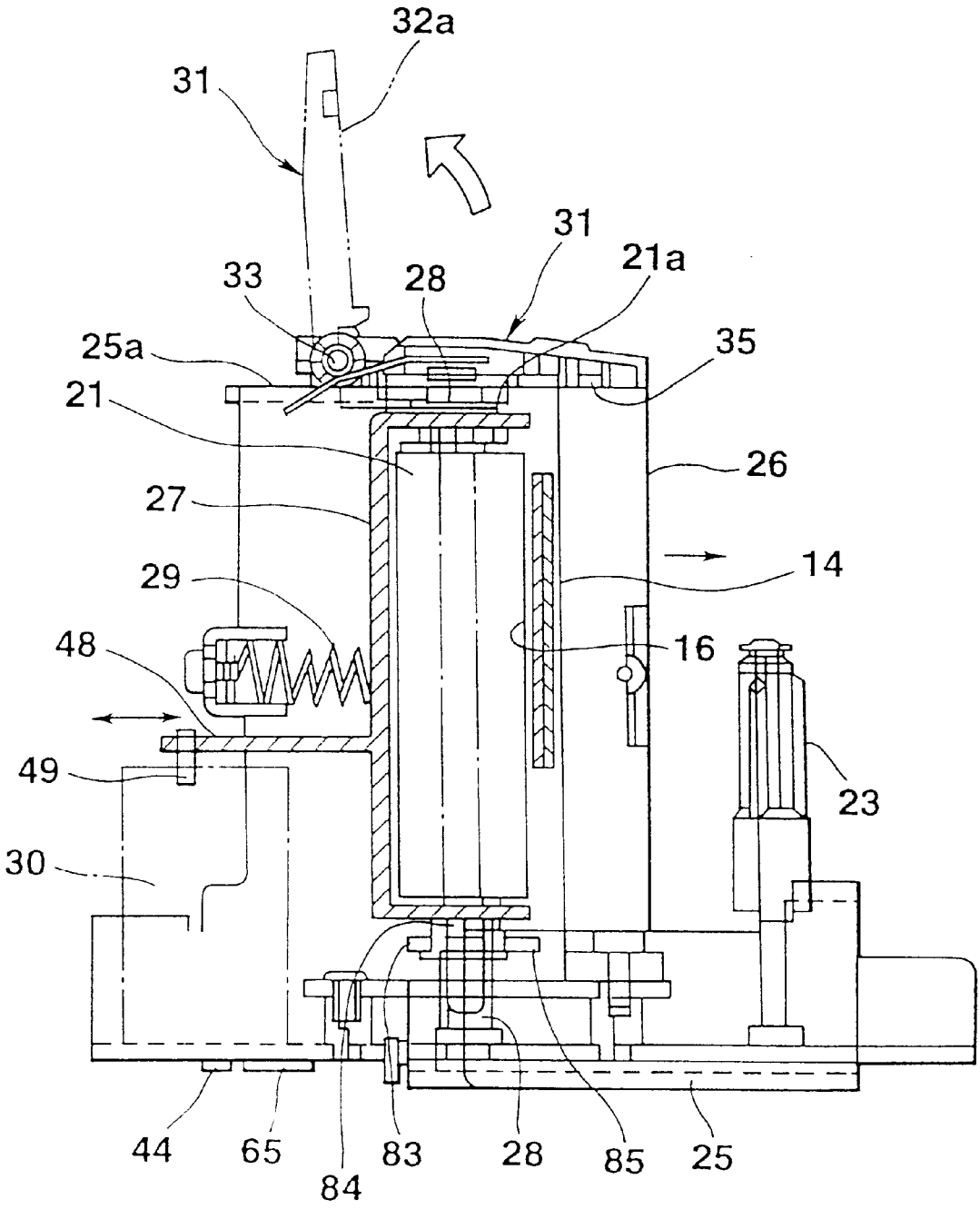
FIG. 10 is a cross-sectional view taken along 10—10 of FIG. 8 in a state where the space between the print head and the platen roller is restricted by the space restricting member.
Figure 11:
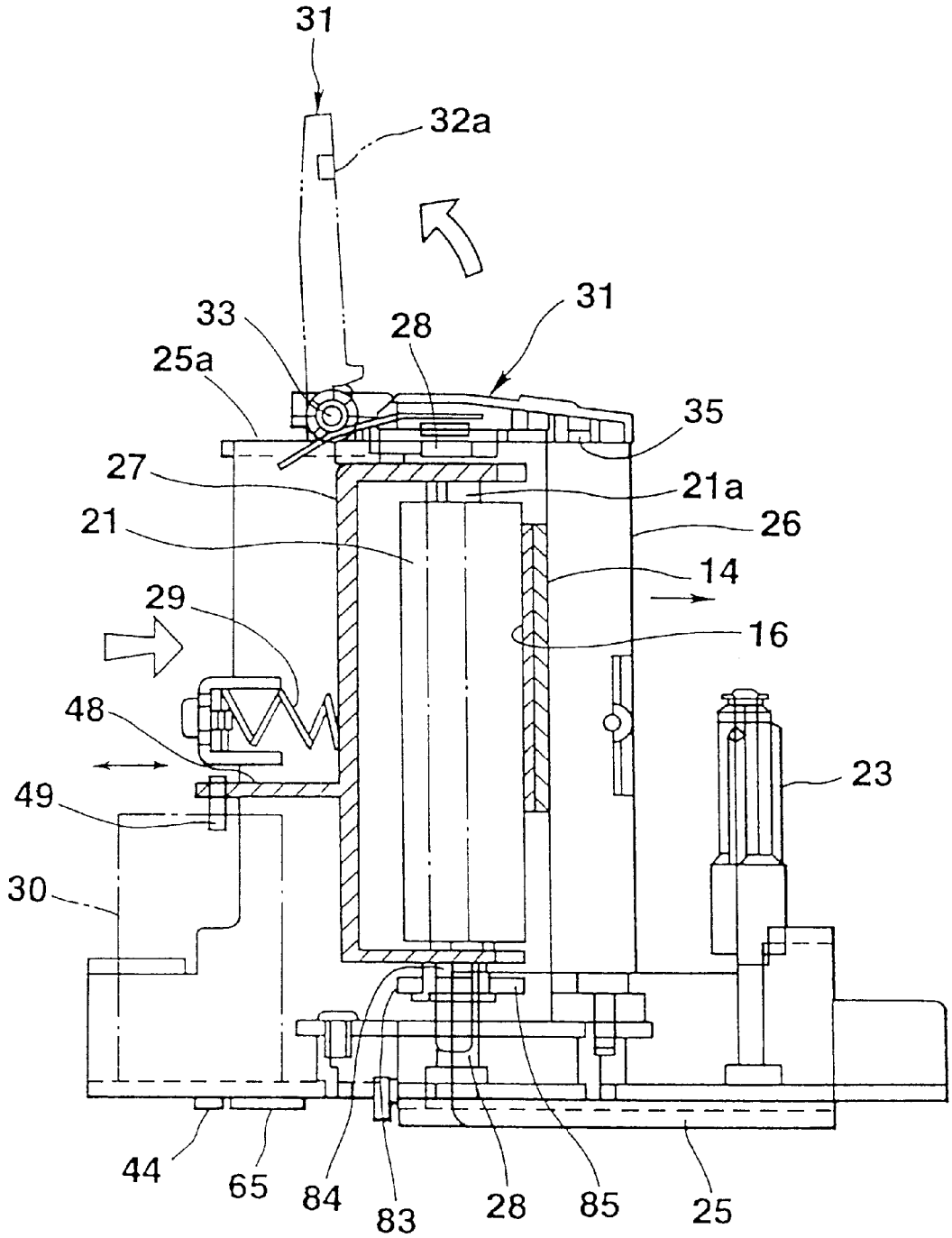
FIG. 11 is a cross-sectional view taken along 11—11 of FIG. 9 in a state where the space between the print head and the platen roller is restricted by the space restricting member.

As shown in FIGS. 10 and 11, a rotational position detector 65 which senses a rotational position of the cam member 30 is attached to the chassis 25 below the cam member 30. As shown in FIG. 13B, the rotational position detector 65 is composed of a pair of first and second reflective type positional sensors 65*a* and 65*b* disposed on a baseplate 65*c*, each sensor being composed of a light emitting element and a photodetection element. The pair of the first and second positional sensors 65*a* and 65*b* senses light reflected by light reflectors 62*a*–62*d* provided on a lower surface of the cam follower gear 62 of the cam member 30 to detect the rotational position of the cam member 30 to produce a corresponding signal. The cam drive mechanism 55 and a print drive mechanism 66 to be described later in more detail are controlled by that signal indicative of the rotational position of the cam member 30. In this case, the first positional sensor 65*a* senses the light reflectors 62*a*, 62*b* provided at predetermined positions in the vicinity of the periphery of the cam follower gear 62 to detect a print position and a cut end position on the cam member 30. The second positional sensor 65*b* senses other two light reflectors 62*c*, 62*d* provided at predetermined positions in the vicinity of the center of the cam follower gear 62 to detect the initial position of the platen roller 21 and the position of the platen roller which presses the print head 20. The cam follower gear 62 is preferably black in itself or in its lower surface.

The print drive mechanism 66 drives the platen roller 21, tape feed shaft 22, and ribbon winding shaft 23 in printing. As shown in FIG. 12, the print drive mechanism 66 is composed of a second motor 67 provided on the chassis 25, a speed reduction gear chain 68 which reduces the rotational speed of the second motor 67, a roller transmission gear chain 69 which transmits the forward rotation of the second motor 67 whose speed is reduced by the reduction gear chain 68 to the platen roller 21, a ribbon transmission gear chain 70 which transmits to the ribbon winding shaft 23 the rotation transmitted to the platen roller 21, and a tape rewinding transmission gear chain 71 which transmits to the tape feed shaft 22 the reverse rotation of the second motor 67 whose speed is reduced by the reduction gear chain 68. The reduction gear chain 68 is composed of an axial gear 72 provided on the output shaft of the second motor 67, a larger gear 73 rotating in meshing relationship to the axial gear 72, a smaller gear 74 integral with the larger gear 73, a larger transmission gear 75 rotating in meshing relationship to the smaller gear 74, and a smaller transmission gear 76 integral with the transmission gear 75. Those gears are attached rotatably to related shafts 77 provided on the chassis 25.

The roller transmission gear chain 69 is composed of a clutch gear 78 rotating in meshing relationship to the smaller transmission gear 71 of the reduction gear chain 68, a first larger-diameter intermediate gear 79 rotating in relationship to the clutch gear 78, a second larger-diameter intermediate gear 81 rotating in meshing relationship to a third intermediate gear 80 integral with the first intermediate gear 79, a larger-diameter roller transmission gear 83 rotating in meshing relationship to a second smaller-diameter intermediate gear 82 integral with the second intermediate gear 81, and a roller follower gear 85 rotating in meshing relationship to a smaller-diameter roller transmission gear 84 integral with the roller transmission gear 83. In this case, the roller follower gear 85 is integral with a lower end of the platen roller 21. The roller transmission gears 83, 84 are attached rotatably on the support shaft 28 of the platen roller 21 so that even when the platen roller 21 rotates around the support shaft 28, the roller follower gear 85 always meshes with the roller transmission gear 84. The clutch gear 78 and the respective intermediate gears 79–82 are attached rotatably on the respective related shafts 77 provided on the chassis 25.

Figure 14:
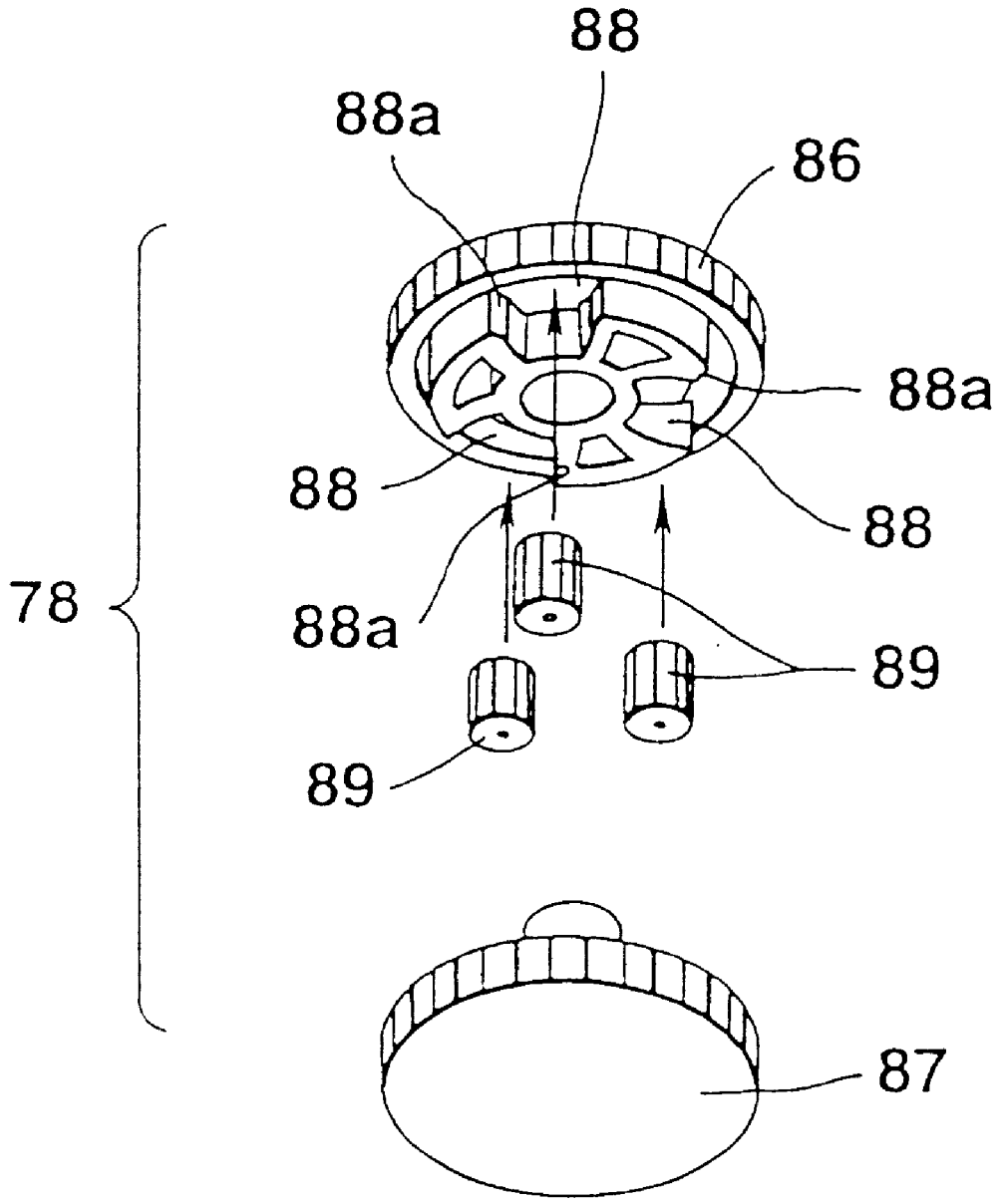
FIG. 14 is an exposed perspective view of a clutch gear.

The clutch gear 78 is a one-way clutch which transmits only a rotation in one direction. As shown in FIG. 14, the clutch gear 78 is composed of a follower gear 86 meshing with the smaller-diameter transmission 71 of the reduction gear chain 68, a transmission gear 87 meshing with the first larger-diameter intermediate gear 79 with the follower gear 86 being attached rotatably to the transmission gear 87, and a plurality of smaller gears 89 disposed within accommodating spaces 88 provided in the follow gear 86 and rotating in meshing relationship to internal teeth (not shown) of the transmission gear 87. When the follower gear 86 rotates in one direction and the smaller gears 89 engage with corresponding inner engagement sides 88*a* in the accommodating spaces 88, the follower gear 86 and the transmission gear 87 rotate as a unit. When the follower gear 86 rotates in the reverse direction and the smaller gears 89 are disengaged from the corresponding engagement sides 88*a* in the accommodating spaces 88, only the follower gear 86 rotates and the transmission gear 87 does not rotate.

The ribbon transmission gear chain 70 is composed of an intermediate gear 90 which rotates in meshing relationship to the larger-diameter roller transmission gear 83 of the roller transmission gear chain 69 attached rotatably to the support shaft 28, and a ribbon follower gear 91 rotating in meshing relationship to the intermediate gear 90 with the ribbon follower gear 91 being attached to the ribbon winding shaft 23 so that the ribbon winding shaft 23 rotates in synchronism with the platen roller 21. The intermediate gear 90 is attached rotatably to an upstanding shaft 77 provided on the chassis 25.

The tape rewinding transmission gear chain 71 is composed of a first intermediate gear 92 which rotates in meshing relationship to the smaller-diameter transmission gear 76 of the reduction gear chain 68, a second larger-diameter intermediate gear 93 rotating in meshing relationship to the first intermediate gear 92, a third smaller-diameter intermediate gear 94 integral with the second intermediate gear 93, a planetary gear 95 which rotates in meshing relationship to the third intermediate gear 94, and a tape follower gear 96 which rotates in separably meshing relationship to the planetary gear 95. In this case, the tape follow gear 96 is attached to the tape feed shaft 22. The first–third intermediate gears 92–94 are attached rotatably to the respective related shafts 77 provided on the chassis 25. The planetary gear 95 is attached rotatably to a gear arm 97 which in turn is attached rotatably to the shaft 77 of the second and third intermediate gears 93 and 94. When the forward rotation of the second motor 67 is transmitted to the planetary gear 95, the gear arm 97 moves the planetary gear 95 away from the tape follow gear 96 whereas when the reverse rotation of the second motor 67 is transmitted to the planetary gear 95, the gear arm 97 rotates so as to move the planetary gear 95 to mesh with the tape follower gear 96.

Figure 15:
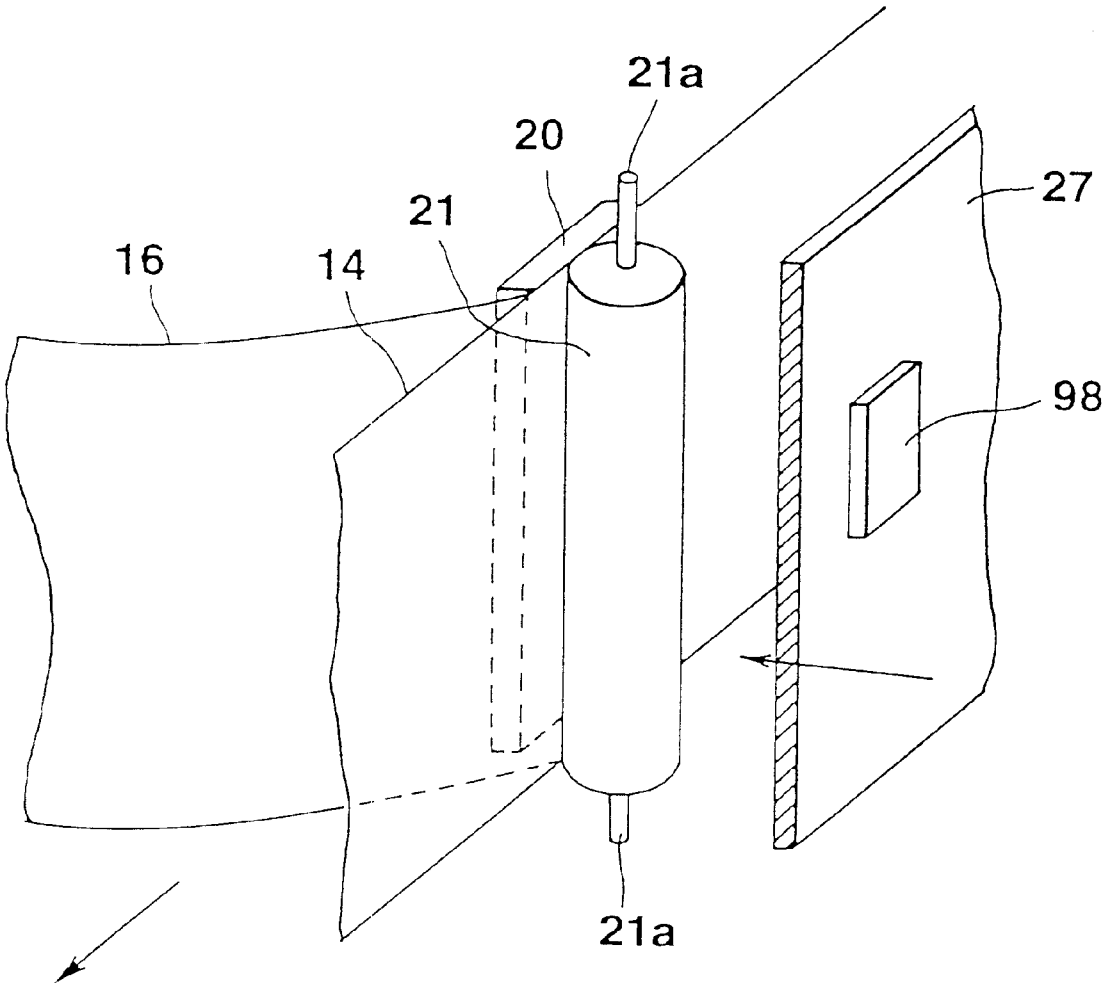
FIG. 15 illustrates a positional relationship between the platen roller and a paper jam sensor.
Figure 16:
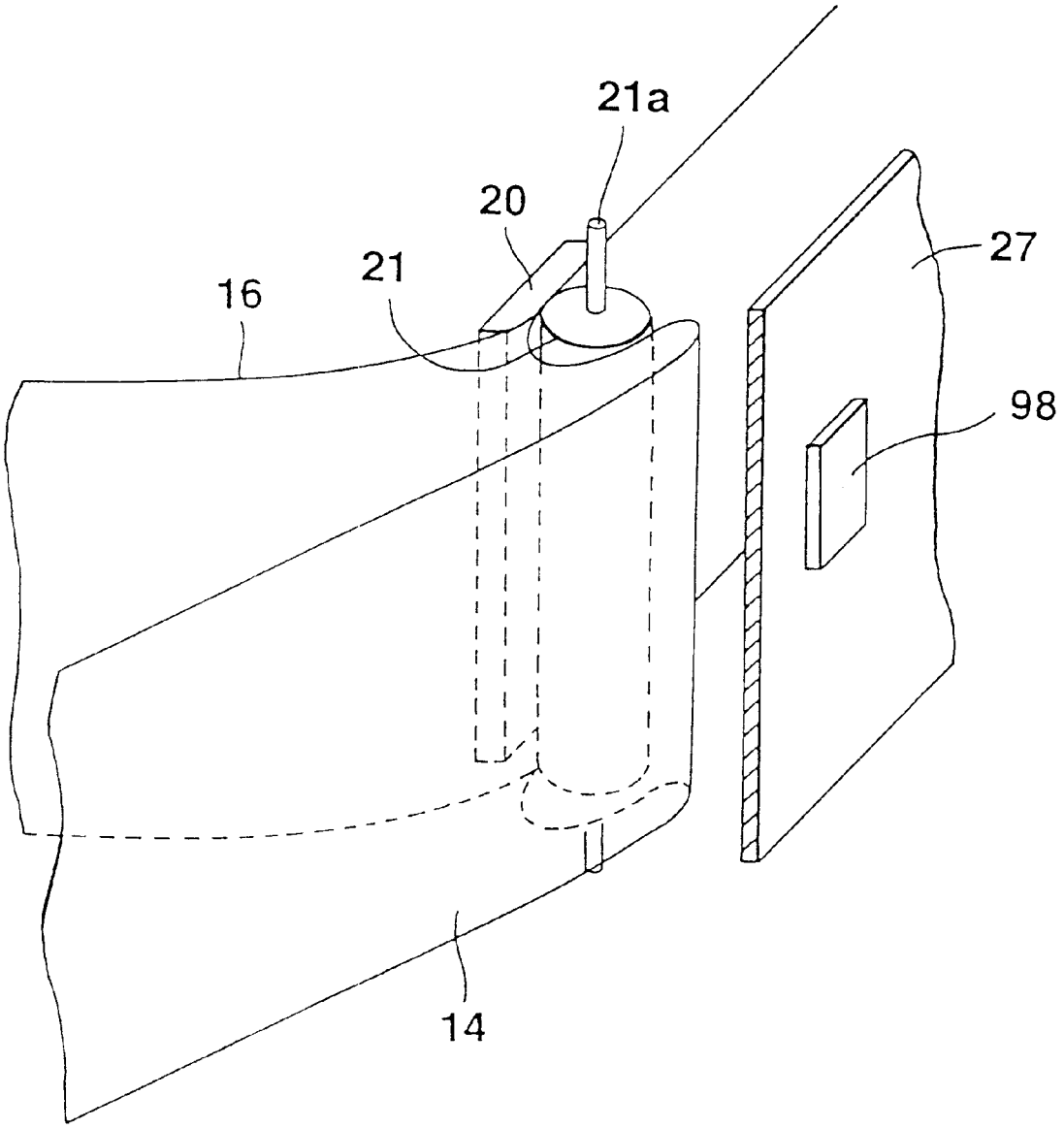
FIG. 16 illustrates a printing tape twined around the platen roller in FIG. 15.
Figure 17:
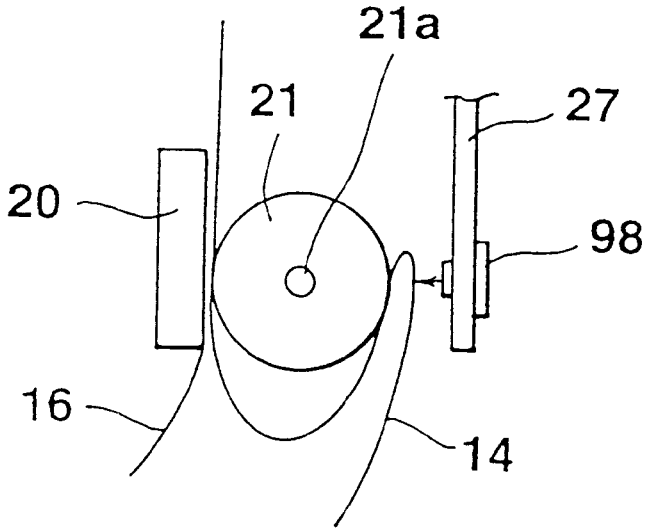
FIG. 17 is a plan view of the printing tape and the platen roller of FIG. 16.
Figure 18:
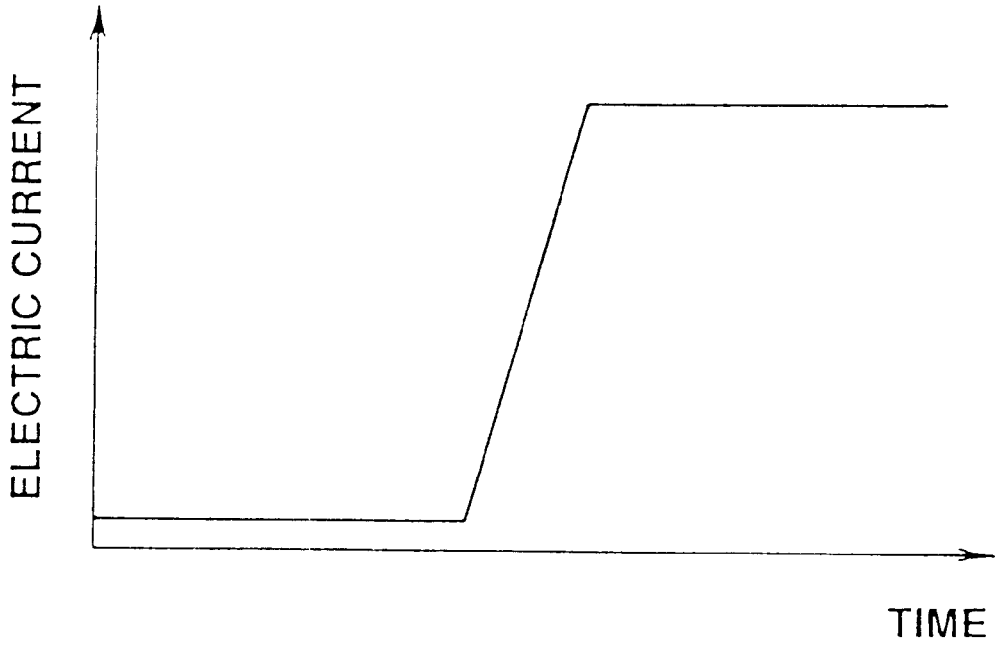
FIG. 18 shows a change in an electric current when a tape jam is sensed by a paper jam sensor.

As shown in FIGS. 15–17, a paper jam sensor 98 which senses that the printing tape 14 is twined around the platen roller 21 is fixed to the support member 27 so that the paper jam sensor 98 always has a constant space to the platen roller 21. The paper jam sensor 98 is of the reflective type which includes a light emitting element and a photodetection element so that a reflection of light emitted by the light emitting element is detected by the photodetection element to output an electric signal indicative of the reflection. In the state where the platen roller 21 is irradiated with light from the light emitting element in the paper jam sensor 98, the platen roller 21 is black because it is made of rubber, and absorbs light, and a quantity of reflected light detected by the photodetection element is small. When the printing tape 14 is twined around the platen roller 21 and inserted into between the platen roller 21 and the support member 27, as shown in FIGS. 16 and 17, light from the light emitting element is reflected by the printing tape 14. Since the photodetection element detects this reflected light, a quantity of light detected by the photodetection element increases, and an electric current flowing out from the photodetection element rapidly increases, as shown in FIG. 18, so that the tape jam is sensed.

The color printing operation of this printer will be described next. First, the tape cassette 4 is set in the cassette receiving recess 5 of the printer body 1. At this time, the platen roller 21 is spaced from the print head 20. The printing tape 14 and the ink ribbon 16 which overlap within the recess 19 in the cassette case 13 are disposed between the spaced platen roller 21 and print head 20, the tape feed shaft 22 is inserted into the hollow cylinder of the tape feed reel 15 of the cassette case 13, and the ribbon winding shaft 23 is inserted into the hollow cylinder of the ribbon winding reel 18 In this state, the cassette cover 2 is closed and the hook 11 of the cassette cover 2 is engaged with the engaging portion 10 in the body 1. At this time, the space restricting member 31 is depressed against the resiliency of the torsion spring 36 by the inner surface of the cassette cover 2, so that the flat portion 32 of the space restricting member 31 is turned around the axle pin 33, the engaging lug 35 provided at the upper end of the protective member 26 of the print head 20 is engaged in the engaging hole 32*a* in the flat portion 32. Thus, the respective upper ends of the platen roller 21 and the print head 20 are maintained at a predetermined space from each other.

Figure 19:
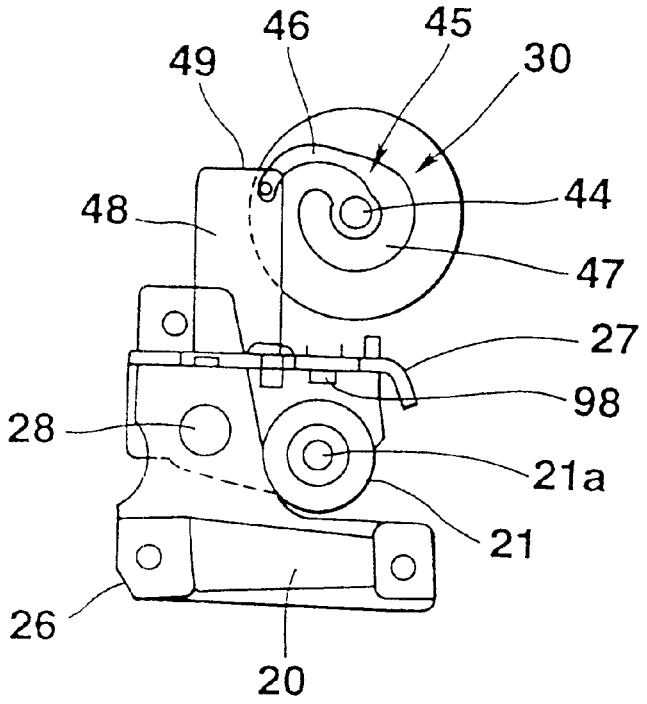
FIG. 19 illustrates the operating position of the platen roller at the initial position of the cam member.
Figure 20:
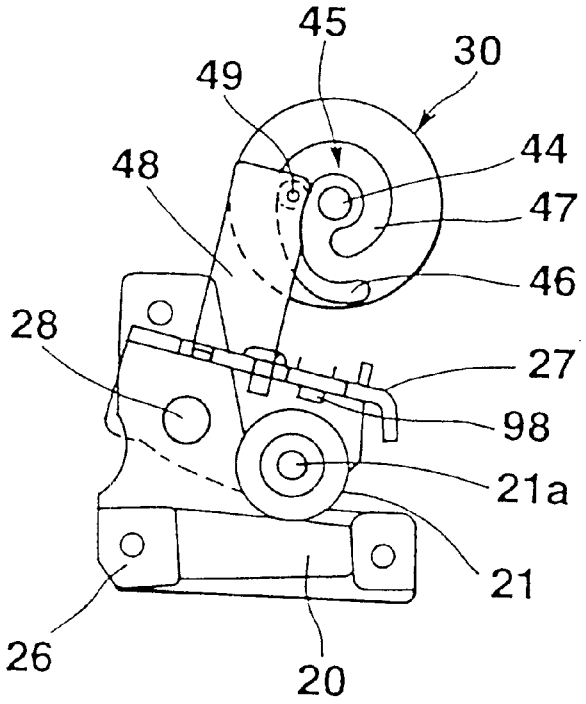
FIG. 20 shows the operating state of the platen roller when the cam member rotates so that a connecting pin arrives at the boundary between a roller driving groove portion and a non-driving groove portion of a first cam groove.

In this state, when the switch unit 3 of the body 1 is operated to instruct the printer to start the printing, the first motor 56 of the cam drive mechanism 55 rotates forward, its rotation is transmitted through the axle gear 57, first intermediate gears 58, 59, second intermediate gears 60, 61 and the cam follower gear 62 to the cam member 30 to thereby rotate same. At this time, as shown in FIG. 19, the connection pin 49 moves in the roller drive groove portion 46 of the first cam groove 45 provided on the upper surface of the cam member 30 from near the outer periphery of the cam cylinder toward the fixed shaft 44, and the roller arm 48 of the support member 27 moves the support member 27 toward the print head 20, so that the support member 27 turns around the support shaft 28 to move the platen roller 21 toward the print head 20. As shown in FIG. 20, when the connection pin 49 approaches the fixed shaft 44, the platen roller 21 is pressed against the print head 20. Thus, the printing tape 14 and the ink ribbon 16 are held between the platen roller 21 and the print head 20 to enable printing.

At this time, the upper ends of the print head 20 and the platen roller 21 are restricted at a predetermined space from each other by the space restricting member 31, so that even when the platen roller 21 is pressed against the print head 20, those upper ends of the print head 20 and the platen roller 21 do not move away from each other unlike the conventional case or they are pressed uniformly against each other. Thus, there is no difference in printing state between the upper and lower portions of the print head 20 and platen roller 21 to ensure uniform printing.

In this print-enable state, the first motor 56 of the cam drive mechanism 55 stops and the print drive mechanism 66 starts to operate on the basis of a detection signal from the rotational position detector 65. More particularly, the second motor 67 of the print drive mechanism 66 rotates forward, and its rotation is transmitted through the reduction gear chain 68 and the roller transmission gear chain 69 to the platen roller 21, and through the roller transmission gear chain 69 and the ribbon transmission gear chain 70 to the ribbon winding shaft 23. At this time, the follower gear 86 of the clutch gear 78 of the roller transmission gear chain 69 rotates forward in meshing relationship to the smaller-diameter transmission gear 71 of the reduction gear chain 69. Thus, the smaller gears 89 are engaged with the corresponding engaging sides 88*a* of the receiving spaces 88, so that the transmission gear 87 rotates along with the follower gear 86 as a unit. This rotation is transmitted through the respective intermediate gears 79–82 and the respective roller transmission gears 83 and 84 to the roller follower gear 85. Thus, the platen roller 21 rotates to feed the printing tape 14, the ribbon winding shaft 23 rotates, and the ribbon winding reel 18 starts to wind the ink ribbon 16.

Simultaneously, the respective heat producing elements of the print head 20 heat in accordance with print information, the color ink, for example cyan ink, of the ink ribbon 16 is sequentially transferred to the printing tape 14. At this time, since the forward rotation of the second motor 67 is transmitted of the planetary gear 95 of the tape rewinding transmission gear chain 71. Thus, the gear arm 97 moves the planetary gear 95 away from the tape follower gear 96, so that the rotation of the planetary gear 95 is not transmitted to the tape follower gear 96, and the tape feed reel 15 in the cassette case 13 is not rotated reversely.

When the printing of one color (for example, in cyan ink) ends, the printing tape 14 is rewound, and the next printing is performed in a different color ink. In this case, first, the first motor 56 of the cam drive mechanism 55 is rotated reversely, its rotation is transmitted through the axle gear 57, the respective intermediate gears 58–61 and the cam follower gear 62 to the cam member 30 to thereby rotate same reversely. As shown in FIG. 20, this moves the connection pin 49 from the vicinity of the fixed shaft 44 toward the outer periphery of the cam cylinder of FIG. 19 in the roller drive groove portion 46 of the first cam groove 45 in the cam member 30 to then return the connection pin 49 to its initial position. Thus, since the roller arm 48 turns the support member 27 around the support shaft 28, the platen roller 21 is moved away from the print head 20 to thereby release the holding of the printing tape 14 and the ink ribbon 16.

As described above, when the platen roller 21 is moved away from the print head 20, the first motor 56 stops in accordance with the detection signal from the rotational position detector 65. In response to this operation, the second motor 67 of the print drive mechanism starts to rotate reversely. This rotation is transmitted through the reduction gear chain 68 to the tape rewinding transmission gear chain 71 to rotate the planetary gear 95 reversely. Thus, the gear arm 97 causes the planetary gear 95 to approach and mesh with the tape follower gear 96. Thus, the reverse rotation of the second motor 67 is transmitted to the tape feed shaft 22 to rotate the tape feed reel 15 reversely within the cassette case 13, and the printed tape 14 is rewound. At this time, the follow gear 86 of the clutch gear 78 in the roller transmission gear chain 69 rotates reversely in meshing relationship to the smaller-diameter transmission gear 71 of the reduction gear chain 68. Thus, the smaller gears 89 are not engaged with the corresponding engaging sides 88*a* in the receiving spaces 88, only the follow gear 86 rotates, and the transmission gear 87 does not rotate. Therefore, the reverse rotation of the second motor 67 is not transmitted to the respective intermediate gears 79–82, so that the platen roller 20 and the ink ribbon winding shaft 23 do not rotate.

When the printing tape 14 is rewound by the printed tape portion, the first motor 56 of the cam drive mechanism 55 again rotates forward to rotate the cam member 30 to thereby move the platen roller 21 toward the print head 20. Thus, the printing tape 14 and the ink ribbon 16 are held again between the platen roller 21 and the print head 20 to thereby bring about a printable state. In response to this operation, the first motor 56 stops its rotation, and the second motor 67 of the print drive mechanism 66 again rotates forward. Thus, the platen roller 21 and the ribbon winding shaft 23 rotate, the print head 20 is driven so as to produce heat to transfer the next different color ink, for example a red ink, in the ink ribbon 16 to the printing tape 14. Such printing operation is sequentially repeated for each color. When a transparent laminate is printed last, the color printing operation ends.

At this time, the second motor 56 of the cam drive mechanism 55 is rotated forward to start to cut the printed tape 14 with the cutter 40. At this time, the cam member 30 rotates forward, the cutter arm 43 turns upward to cut the printed tape 14. In response to this operation, the first motor 56 starts to rotate reversely to rotate the cam member 30 reversely. In response to this operation, the movable edge 42 of the cutter 40 is then operated in a direction opposite to its previous direction to move away from the fixed edge 41 to return to its initial position, and the platen roller 21 is moved away from the print head 20 to return to its initial position, so that the tape cassette 4 is replaceable with another.

While the printing continues, for example, the leading end of the printed tape 14 can be caught in the tape exit 24 or the fixed edge 41 of the cutter 40. If the printing continues under this situation, the printing tape 14 can be twined around the platen roller 21 to become jammed, as shown in FIGS. 16 and 17 because the printed tape 14 is sequentially fed out. In such a case, the twined printed tape 14 is inserted between the platen roller 21 and the support member 27, so that this printing tape 14 is sensed by the paper jam sensor 98 provided on the support member 27, and the rotation of the second motor 67 is stopped on the basis of a detection signal from the paper jam sensor 98 to alert the user to the tape jamming.

More particularly, the platen roller 21 is normally irradiated with light from the light emitting element and a quantity of its reflected light is small. When the printing tape 14 is inserted between the platen roller 21 and the support member 27, the light from the light emitting element is reflected by the printing tape 14, and the quantity of reflected light detected by the photodetector element of the paper jam sensor 98 increases. Thus, the output current from the photodetection element rapidly increases, as shown in FIG. 18, to thereby detect the tape jamming. In response to this operation, the second motor 67 of the print drive mechanism 66 rapidly stops in accordance with a detection signal from the paper jam sensor 98 and an error message is displayed on the display unit 4. Thus, a waste of the printing tape 14 and the ink ribbon 16, excessive twining of the print tape 14, and breakage of the printer body 1 occurring when the printing tape is forcibly taken out are avoided.

As described above, in the printer, the support shaft 28 to which the support member 27 of the platen roller 21 is attached is fixed at its lower end to the chassis 25, the support shaft 28 is fixed at its upper end to the upper attaching portion 25*a* of the chassis 25, the space restricting member 31 is attached turnably by the axle pin 33 to the upper attaching portion 25*a* of the chassis 25, the engagement lug 35 at the upper end of the upstanding protective member 26 provided on the chassis 25 is engaged in the engaging hole 32*a* in the space restricting member 31 to restrict the respective upper ends of the print head 20 and the platen roller 21 at the predetermined space from each other. Thus, the respective upper ends of the print head 20 and the platen roller 21 are prevented from moving away from each other during printing, both the print head 20 and the platen roller 21 are pressed against each other uniformly through their length. Thus, there is no difference in printing state between the upper and the lower portions of the print head 20 and the platen roller 21 to ensure uniform printing to thereby improve the print quality.

In this case, especially, the support shaft 28 of the platen roller 21 is fixed at its lower end to the chassis 25, and at its upper end to the upper attaching portion 25*a* of the chassis 25, so that the support shaft 28 is firmly fixed to the chassis 25. Thus, the platen roller 21 is firmly fixed to the chassis 25. In addition, the space restricting member 31 provided at the upper attaching portion 25*a* of the chassis 25 to which the support shaft 28 is fixed at its upper end is engaged with the upper end of the print head 20. Thus, the respective upper ends of the print head 20 and the platen roller 21 are prevented from moving away from each other.

The space restricting member 31 is biased so as to be upstanding on the upper attaching portion 25*a* of the chassis 25 by the torsion spring 36. Thus, when a tape cassette 4 is set in the cassette receiving space 5, the space restricting member 31 is not a hindrance, and the print tape 14 and the ink ribbon 16 are easily inserted between the print head 20 and the platen roller 21. When the cassette cover 2 is opened, the push button 12 provided on the upper surface of the printer body 1 is required to be depressed to release the engagement of the hook 11 in the cassette cover 2 with the engaging portion 10. In response to this operation, the space restricting member 31 upstanding based on the resiliency of the torsion spring 36 pushes the cassette cover 2 upward to open same automatically.

Second Embodiment

Figure 21:
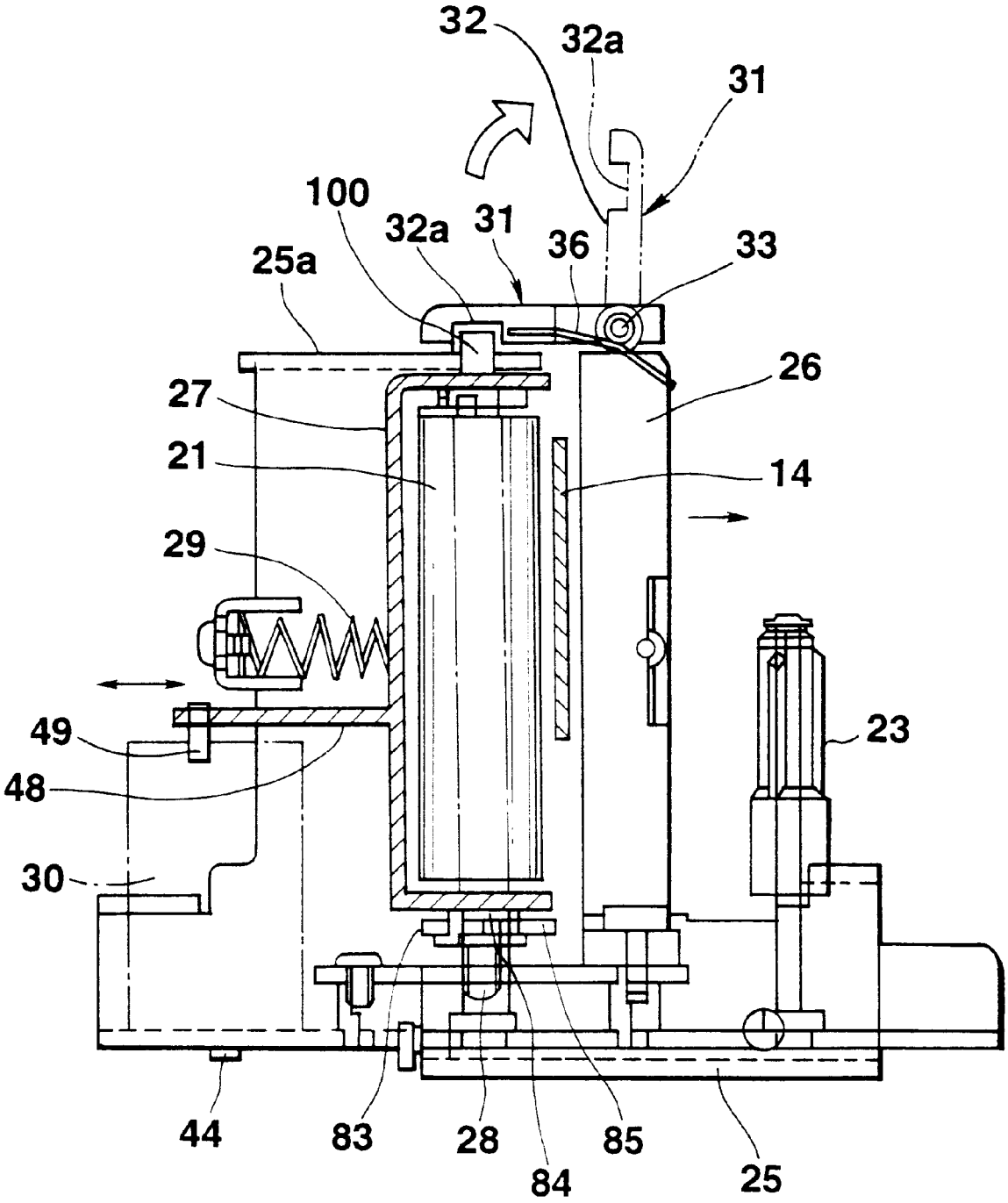
FIG. 21 is a cross-sectional view of an essential portion of a second embodiment of the inventive printer.

Referring to FIG. 21, a second embodiment of the printer according to the present invention will be described next. The same reference numeral is used to identify similar elements of the second and first embodiments shown in FIGS. 21 and 1–20 and their further description will be omitted.

In the printer of FIG. 21, the protective member 26 to which the print head 20 is fixed is fixed at a lower end to the chassis 25, so that the protective member 26 is attached upstanding to the chassis 25, and a flat portion 32 of the space restricting member 31 is attached turnably by an axle pin 33 to an upper end of the protective member 26. The flat portion 32 has an engaging hole 32*a* which is engageble with an engaging lug 100 provided on the upper attaching portion 25*a* of the chassis 25, so that the respective upper ends of the print head 20 and the platen roller 21 are restricted at a predetermined space from each other.

In the printer, a torsion spring 36 is born around the axle pin 33 of the space restricting member 31 so that the flat portion 32 is biased upstanding. The other structural portions of the second embodiment are similar to those corresponding portions of the first embodiment. Also, in this case, the support shaft 28 which supports the support member 27 of the platen roller 21 rotatably is fixed at a lower end to the chassis 25 and fixed at an upper end to the upper attaching portion 25*a* of the chassis 25, so that the support shaft 28 is fixed upstanding to the chassis 25.

When in this printer a tape cassette 4 is set in the cassette receiving recess 5 of the printer body 1 and the cassette cover 2 is then closed to cause the hook 11 of the cassette cover 2 to engage with the engaging portion 10 in the cassette receiving space 5, the flat portion 32 of the space restricting member 31 is pushed down against the resiliency of the torsion spring 36 by the inner surface of the cassette cover 2, so that the flat portion 32 is turned around the axle pin 33, the engaging hole 32*a* in the flat portion 32 is engaged with the engaging lug 100 provided in the attaching portion 25*a* of the chassis 25 to thereby restrict the upper ends of the print head 20 and the platen roller 21 at the predetermined space from each other. Thus, as in the first embodiment, the upper ends of the print head 20 and the platen roller 21 are prevented from moving away from each other to thereby press both against each other uniformly along their lengths. Thus, there is no difference in printing state between the upper and lower portions of the print head and the platen roller 21 to ensure uniform printing and improve the print quality.

Also, in this case, the support shaft 28 of the platen roller 21 is fixed at its lower end to the chassis 25 and at its upper end to the upper attachment 25*a* of the chassis 25, so that the support shaft 28 is fixed firmly to the chassis 25 and the platen roller 21 is firmly fixed to the chassis 25. Thus, even when the protective member 27 which fixes the print head 20 is fixed only at its lower end to the chassis 25, the upper ends of the print head 20 and the platen roller 21 are prevented from moving away from each other by the space restricting member 31 provided at the upper end of the protective member 26.

The space restricting member 31 is biased so as to be upstanding on the upper end of the protective member 26 by the torsion spring 36, so that when a tape cassette 4 is set in the cassette receiving space 5, the space restricting member 31 is not a hindrance, and the printing tape 14 and the ink ribbon 16 are easily inserted between the print head 20 and the platen roller 21, as in the first embodiment. If the push button 12 provided on the upper surface of the printer body 1 is depressed to release the engagement of the engaging portion 10 with the hook 11 of the cassette cover 2, the space restricting member 31 upstanding due to the resiliency of the torsion spring 36 pushes the cassette cover 2 upward to open same automatically.

Third Embodiment

Figure 22:
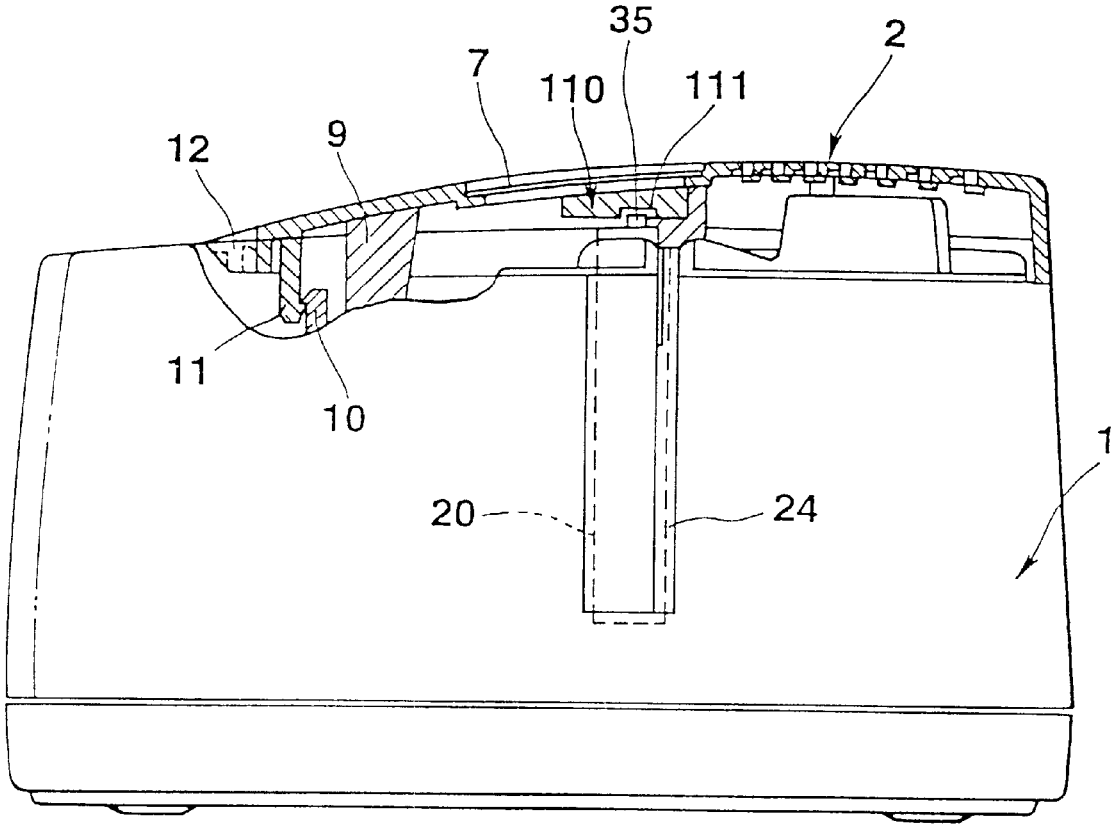
FIG. 22 is a broken-away side view of an essential portion of a third embodiment of the inventive printer with a cassette cover being closed.
Figure 23:
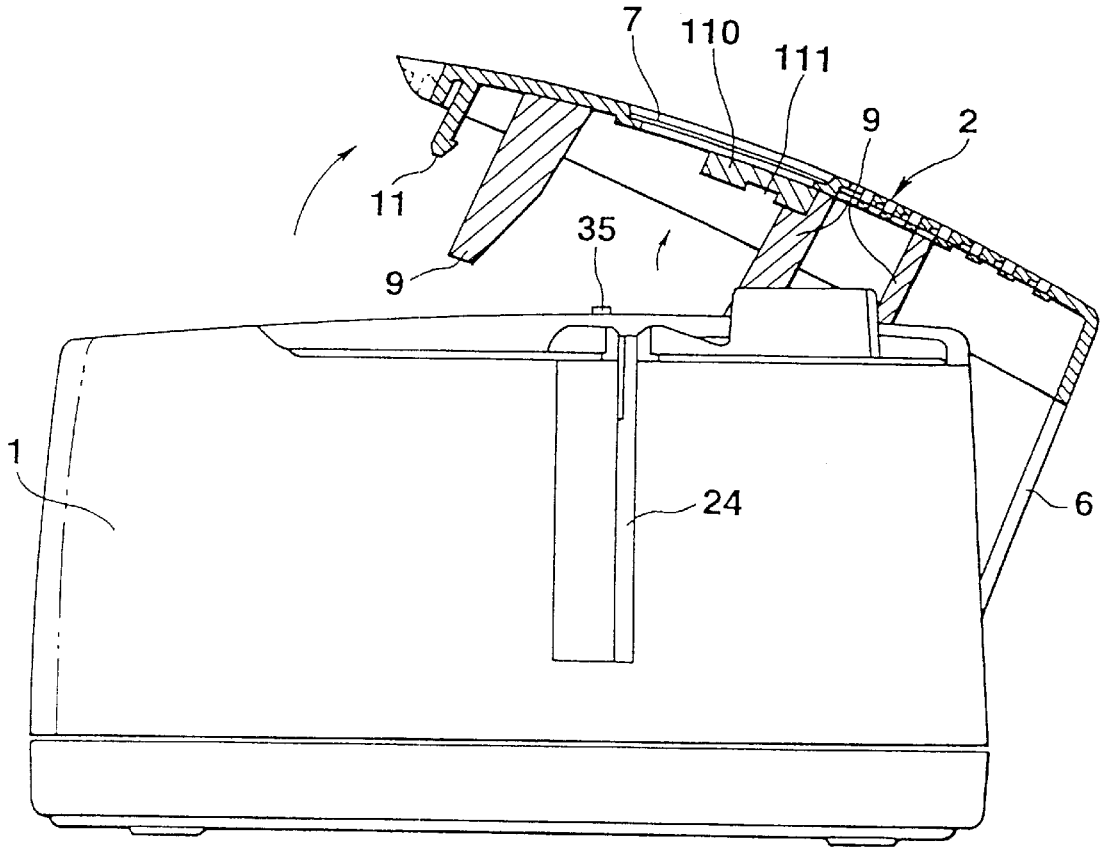
FIG. 23 is a side view of the printer of FIG. 22 with its cassette cover being open.

Referring to FIGS. 22 and 23, a third embodiment of the printer according to the present invention will be described next. Also, in this case, the same reference numeral is used to identify similar elements of the third and first embodiments of FIGS. 22 and 23 and FIGS. 1–20 and their further description will be omitted.

In the printer of FIGS. 22 and 23, a space restricting member 110 is provided on an inner surface of the cassette cover 2 attached openably to the printer body 1. An engaging recess 111 is provided on a lower surface of the space restricting member 110 so that the engaging recess 111 is engagble with an engaging lug 35 provided at an upper end of the protective member 26 of the print head 20 to fix the upper end of the protective member 26 to restrict the upper ends of the print head 20 and platen roller 21 at a predetermined space from each other. The other structural portions of the third embodiment are similar to those corresponding portions of the first embodiment. Also, in this case, the protective member 26 to which the print head 21 is fixed is fixed at a lower end to the chassis 25 to thereby maintain the protective member 26 in an upstanding state. The support shaft 28 which supports the support member 27 of the platen roller 21 rotatably is fixed at a lower end to the chassis 25 and fixed at an upper end to the upper attaching portion 25*a* of the chassis 25 to thereby fix the support shaft 28 to the chassis 25 in an upstanding state.

When in this printer a tape cassette 4 is set in the cassette receiving space 5 of the printer body 1 and the cassette cover 2 is then closed to cause the hook 11 of the cassette cover 2 to engage with the engaging portion 10 in the cassette receiving space 5, the engaging recess 111 in the space restricting member 110 provided on the internal surface of the cassette cover 2 is engaged with the engaging lug 35 provided on the upper end of the protective member 26 to thereby fix the upper end of the protective member 26 and hence restrict the upper ends of the print head 20 and the platen roller 21 at the predetermined space from each other. Thus, as in the first embodiment, the upper portions of the print head 20 and the platen roller 21 are prevented from moving away from each other to thereby press both against each other uniformly along their lengths. Thus, there is no difference in printing state between the upper and lower portions of the print head and the platen roller 21 to ensure uniform printing and improve the print quality.

By opening/closing the cassette cover 2, at least one of the upper ends of print head 20 and platen roller 21 is disengaged/engaged by the space restricting member 110 attached to the cassette cover 2. Thus, the trouble to engage/disengage the space restricting member 110 with/from the upper portions of the print head 20 and platen roller 21 is saved. Since the space restricting member 110 is attached to the cassette cover 21, a space required for attaching the space restricting member 110 on the side of the printer body 1 is eliminated to thereby contribute to reduction of the size of the printer.

While in the third embodiment the engaging lug 35 of the protective member 26 is engaged disengagably in engaging recess 111 alone provided in the space restricting member 110, the present invention is not limited to this particular case. For example, arrangement may be such that an engaging lug provided also on the upper attaching portion 25*a* of the chassis 25 which fixes the upper end of the support shaft 28 of the platen roller 21 and the engaging lug 35 of the protective member 26 are engaged disengageably in corresponding engaging recesses provided in the space restricting member so that the space restricting member restricts the respective upper ends of the print head 20 and the platen roller 21 at a predetermined space from each other.

While in any one of the first–third embodiments the support shaft 28 which supports the support member 27 of the platen roller 21 rotatably is fixed at the lower end thereof to the chassis 25 and at the upper end to the upper attaching portion 25*a* of the chassis 25 to thereby fix the support shaft 28 in an upstanding state to the chassis 25, the present invention is not limited to this particular case. For example, arrangement may be such that the support shaft 28 is fixed only at its lower end to the chassis 25 so as to be upstanding and that a space restricting member may be provided on an upper end of one of the support member 27 attached to the support shaft 28 and the protective member 26 of the print head 20 which is fixed only at the lower end so as to engage with the upper end of the other of the support member 27 and the protective member 26. Alternatively, a space restricting member may be provided on the chassis 25 so as to engage with both the upper ends of the support member 27 and the protective member 26.

While in any one of the first–third embodiments the print head 20, platen roller 21, tape feed shaft 22 and ribbon winding shaft 23 are illustrated as being disposed in an upstanding manner within the cassette receiving recess 5 open up at 1*a* below in the cover of the printer body 1, as shown in FIGS. 2 and 7, the present invention is not limited to this particular case. For example, arrangement may be such that a laterally open cassette receiving space 5 is provided on a side of the body 1 so that the print head 20, platen roller 21, tape feed shaft 22 and ribbon winding shaft 23 may be cantilevered within the cassette receiving space 5.

While the platen roller 21 having a given shape is used in any one of the first–third embodiments, the present invention is not limited to this particular case. For example, the platen may have another shape.

While in any one of the first–third embodiments, (1) the platen roller 21 is attached to the chassis 25 within the printer body 1, (2) the protective member 26 which is a part of the chassis is fixed at a lower end to chassis 25 and (3) the print head 20 is fixed within the protective member 26, the present invention is not limited to this particular case. For example, the platen roller 21 and/or print head 20 may be directly fixed to the printer body 1.

While in the first–third embodiments the arrangement has been illustrated in which the print head 20 is fixed to the chassis 25, and the platen roller 21 is attached movably to the chassis 25 so that the platen roller 21 is movable toward/away from the print head 20, the present invention is not limited to this particular case. For example, the present invention is applicable to an arrangement in which the platen roller 21 is fixed to the chassis 25, and in which the print head is attached movably to the chassis 25 so that the print head 20 is movable toward/away from the platen roller 21.

While in the first–third embodiments the attachment of the space restricting member to any one of the upper attaching portion 25*a* of the chassis 25 which is attached within the printer body 1, the upper end of the protective member 26 to which the print head 20 is fixed, and the inner surface of the cassette cover 2 has been described, the present invention is not limited to this particular case. The space restricting member may be attached to the printer body 1.

We claim:

1. A printer comprising:

a printer body;

a print head having a plurality of heat producing elements arranged in a lengthwise direction of the print head, said print head having a first end fixed to the printer body and a second end;

a platen roller having first and second ends supported by a support member;

means for moving the support member, while maintaining the platen roller and the print head in parallel, between a first position at which the platen roller contacts with the print head and a second position at which the platen roller is separated from the print head by a predetermined distance;

means for pressing the platen roller against the print head when the platen roller is brought into contact with the print head; and means for holding the second end of the print head linked to the printer body, said holding means being arranged above the print head and being movable in the lengthwise direction of the print head so as to hold the print head at a desired position during a printing operation of the printer.

2. The printer according to claim 1, wherein the holding means comprises a first end which is rotatable supported by the printer body, and a second end which includes an engaging portion for disengageably engaging with a to-be-engaged portion of the second end of the print head, said engaging portion of the second end of the holding means being engaged with to-be-engaged portion of the second end of the print head when the holding means is rotated in a first direction, and said engaging portion of the second end of the holding means being released from the to-be-engaged portion of the second end of the print head when the holding means is rotated in a second direction.

3. The printer according to claim 2, further comprising:

a cover member movable between an open position and a closed position, said cover member covering the print head, the platen roller, the moving means, the pressing means and the holding means when the cover member is in the closed position;

a latch for releasably latching the cover member in the closed position; and means for biasing the holding means toward the cover member so as to move the holding means to a position at which engagement between the to-be-engaged portion of the second end of the print head and the engaging portion of the second end of the holding means is released, and so as to move the cover member to the open position from the closed position when the latch is released.

4. A printer according to claim 1, wherein said holding means comprises a first end which is rotatably supported by the print head, and a second end which includes an engaging portion for disengageably engaging with a to-be-engaged portion of the printer body, said engaging portion of the second end of the holding means being engaged with the to-be-engaged portion of the printer body when the holding means is rotated in a first direction, and said engaging portion of the second end of the holding means being released from the to-be-engaged portion of the printer body when the holding means is rotated in a second direction.

5. The printer according to claim 4, further comprising:

a cover member movable between an open position and a closed position, said cover member covering the print head, the platen roller, the moving means, the pressing means and the holding means when the cover member is in the closed position;

a latch for releasably latching the cover member in the closed position; and means for biasing the holding means toward the cover member so as to move the holding means to a position at which engagement between the to-be-engaged portion of the printer body and the engaging portion of the second end of the holding means is released, and so as to move the cover member to the open position from the closed position when the latch is released.

6. A printer comprising:

a printer body;

a print head having a plurality of heat producing elements arranged in a lengthwise direction of the print head, said print head having a first end fixed to the printer body and a second end;

a platen roller having first and second ends supported by a support member;

means for moving the support member, while maintaining the platen roller and the print head in parallel, between a first position at which the platen roller contacts with the print head and a second position at which the platen roller is separated from the print head by a predetermined distance;

means for pressing the platen roller against the print head when the platen roller is brought into contact with the print head; and a cover movable between an open position and a closed position, said cover covering the print head, the platen roller, the moving means, and the pressing means and holding the second end of the print head so as to maintain a position of the print head during a printing operation of the printer when said cover is in the closed position.

* * * * *